US011965513B2

(12) United States Patent
Alkad et al.

(10) Patent No.: US 11,965,513 B2
(45) Date of Patent: Apr. 23, 2024

(54) PROTECTING CENTRIFUGAL PUMPS FROM CAVITATION THROUGH APPLIED MATHEMATICAL TECHNIQUE

(71) Applicant: Saudi Arabian Oil Company, Dhahran (SA)

(72) Inventors: Khalid Alkad, Jeddah (SA); José Rosario Leal Vargas, Jeddah (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/475,051

(22) Filed: Sep. 14, 2021

(65) Prior Publication Data

US 2023/0081667 A1 Mar. 16, 2023

(51) Int. Cl.
*F04D 15/02* (2006.01)
*F04D 13/14* (2006.01)
*F04D 15/00* (2006.01)

(52) U.S. Cl.
CPC ..... *F04D 15/0218* (2013.01); *F04D 13/14* (2013.01); *F04D 15/0072* (2013.01)

(58) Field of Classification Search
None
See application file for complete search history.

(56) References Cited

U.S. PATENT DOCUMENTS 3,797,966 A * 3/1974 Randell ..... F04D 15/0066 417/47
4,841,721 A * 6/1989 Patton ..... F01K 21/047 60/39.181
5,213,477 A * 5/1993 Watanabe ..... F04B 49/065 417/20
6,464,464 B2 10/2002 Sabini et al.
2002/0123856 A1* 9/2002 Eryurek ..... G05B 23/0243 702/140
2003/0060989 A1 3/2003 Shigehara et al.
2005/0241835 A1 11/2005 Burris, II et al.
(Continued)

FOREIGN PATENT DOCUMENTS

CN 2499612 7/2002
CN 2859041 1/2007
CN 103712199 8/2015
(Continued)

OTHER PUBLICATIONS

Machine Translation of WO 2005/080798 (Obtained from USPTO Search, Clarivate Analytics 2023) (Year: 2023).*
(Continued)

*Primary Examiner* — Essama Omgba
*Assistant Examiner* — Geoffrey S Lee
(74) *Attorney, Agent, or Firm* — Fish & Richardson P.C.

(57) ABSTRACT

A system and method for operating centrifugal pumps related to net positive suction head (NPSH), including identifying a group of centrifugal pumps and deriving an equation for the group based on manufacturer data of the centrifugal pumps collectively in the group, the equation correlating NPSH required (NPSHr) with flowrate of pumped fluid, wherein the manufacturer data includes NPSHr for each centrifugal pump of the group as a function of the flowrate of the pumped fluid. The technique includes specifying a NPSH margin for NPSH available (NPSHa) above the NPSHr.

26 Claims, 8 Drawing Sheets

700

(56) References Cited

U.S. PATENT DOCUMENTS

2017/0130575 A1 5/2017 Jaffrey

FOREIGN PATENT DOCUMENTS

| | | | | |
|---|---|---|---|---|
| CN | 104504219 | | 8/2017 | |
| JP | H 07122486 | | 12/1995 | |
| WO | WO-2005080798 | A1 * | 9/2005 | ..... F04D 15/0088 |

OTHER PUBLICATIONS ansi.org [online], "Specification for Horizontal End Suction Centrifugal Pumps for Chemical Process," ANSI Webstore, ASME B73.1-2012, 2012, retrieved on Jul. 30, 2021, retrieved from URL <https://webstore.ansi.org/Standards/ASME/ASMEB732012>, 5 pages.
Grist, "The NPSH performance indicator, NPSH(π)," World Pumps, Apr. 2011, 4: 36-40, 5 pages.
Li et al., "Cavitation simulation and NPSH prediction of a double suction centrifugal pump," IOP Conference Series: Earth and Environmental Science, 15 062025, 2012, 8 pages.
Lorusso et al., "Efficient CFD evaluation of the NPSH for centrifugal pumps," Energy Procedia, ATI 2017—72nd Conference of the Italian Thermal Machines Engineering Association, Elsevier, Sep. 2017, 126: 778-785, 8 pages.
plantservices.com [online], "Practical considerations for modern BFW pumps," Aug. 2015, retrieved on Nov. 29, 2021, retrieved from URL <https://www.plantservices.com/articles/2015/practical-considerations-for-modern-bfw-pumps/>, 8 pages.
Vinurashini et al., "Computer based Boiler Feed Pump Protection and Changeover Scheme," International Conference on Energy Efficient Technologies for Sustainability, Apr. 10-12, 2013, 6 pages.
SAIP Examination Report in Saudi Arabian Appln. No. 122440198, dated Oct. 16, 2023, 10 pages, with English Translation.

* cited by examiner

100

200

300

400

500

600

700

800

PROTECTING CENTRIFUGAL PUMPS FROM CAVITATION THROUGH APPLIED MATHEMATICAL TECHNIQUE

TECHNICAL FIELD

This disclosure relates to centrifugal pumps.

BACKGROUND

A pump is a machine or device utilized to force a liquid or gas to flow in a particular direction. A centrifugal pump employs an impeller to move water or other fluids (primarily liquids). Centrifugal pumps transport fluids by the conversion of rotational kinetic energy to the hydrodynamic energy of the fluid flow. The rotational energy may typically come from an electric motor. A centrifugal pump is a mechanical device designed to move a fluid by transfer of rotational energy from a driven rotor called an impeller. The rotating impeller receives the fluid and casts out the fluid by centrifugal force along the circumference of the impeller through vane tips of the impeller. The centrifugal pump adds head. The centrifugal pump generally increases the pressure of the pumped fluid. The discharge pressure of the centrifugal pump is typically greater than the inlet (suction) pressure of the centrifugal pump.

Cavitation may occur in the centrifugal pump when the pressure of the liquid flowing through (being pumped by) the pump drops below the vapor pressure of the liquid, such that the liquid evaporates (vaporizes) in the pump. Cavitation may be the rapid formation and subsequent collapse of vapor bubbles in the flowing liquid. Cavitation can cause vibration of the centrifugal pump and can pit metal surfaces of the pump, and thus lead to failure of the centrifugal pump.

The liquid to be pumped may drop below its vapor pressure at the pump suction when the liquid is at a relatively high temperature and thus having a high vapor pressure, and/or when pressure drop due to friction losses in the suction system piping upstream of the pump is large. Liquid being pumped may generally drop to below the vapor pressure of the liquid (and thus vaporize) in the centrifugal pump when the net positive suction head available (NPSHa) for the pump falls below the net positive suction head required (NPSHr) for the pump.

SUMMARY

An aspect relates to a method of operating centrifugal pumps related to net positive suction head (NPSH), the method including identifying a group of centrifugal pumps in a system. The method includes deriving an equation for the group based on manufacturer data of the centrifugal pumps collectively in the group, the equation correlating NPSH required (NPSHr) with flowrate of pumped fluid, wherein the manufacturer data includes NPSHr for each centrifugal pump of the group as a function of the flowrate of the pumped fluid. The method includes specifying a NPSH margin for NPSH available (NPSHa) above the NPSHr. The method includes shutting down a centrifugal pump in operation of the group in response to the NPSHa for that centrifugal pump being less than a sum of the NPSHr calculated via the equation for that centrifugal pump plus the NPSH margin as specified.

Another aspect is a method of operating centrifugal pumps related to NPSH, the method including grouping multiple centrifugal pumps in a system for application of an equation to the multiple centrifugal pumps, the equation giving NPSHr as a function of flowrate of pumped fluid. The method includes developing the equation based collectively on manufacturer data of each centrifugal pump of the multiple centrifugal pumps, wherein the manufacturer data varies respectively among the multiple centrifugal pumps. The method includes specifying as a protection a NPSH margin for NPSHa above the NPSHr. The method includes shutting down a centrifugal pump of the multiple centrifugal pumps in response to the NPSHa for that centrifugal pump being less than a sum of the NPSHr calculated via the equation for that centrifugal pump plus the NPSH margin as specified.

Yet another aspect is a method of operating centrifugal pumps related to NPSH, the method including designating a group of centrifugal pumps in a system. The method includes generating a single equation for the group based on manufacturer data of the centrifugal pumps collectively in the group, the equation correlating NPSHr with flowrate of pumped fluid, wherein the manufacturer data gives the NPSHr for each centrifugal pump of the group as a function of the flowrate of the pumped fluid, and wherein the NPSHr of the manufacturer data at a given flowrate of the pumped fluid varies among the centrifugal pumps of the group. The method includes specifying a NPSH margin for NPSHa above the NPSHr. The method includes calculating, via the single equation, the NPSHr for each centrifugal pump in operation of the group at a respective operating flowrate of the pumped fluid. The method includes comparing the NPSHa for each respective centrifugal pump in operation of the group to a sum of the NPSH margin plus the NPSHr as calculated via the single equation for each respective centrifugal pump in operation of the group.

Yet another aspect is a system including a group of centrifugal pumps specified collectively for control via an equation correlating NPSHr of the group with flowrate of pumped fluid based on manufacturer data including factory acceptance tests (FAT) data of the centrifugal pumps, wherein the FAT data gives the NPSHr for each centrifugal pump of the group as a function of the flowrate of the pumped fluid, and wherein the NPSHr of the FAT data at a given flowrate of the pumped fluid varies among the centrifugal pumps of the group. The system includes a control system to calculate, via the equation, the NPSHr for each centrifugal pump in operation of the group at a respective operating flowrate of the pumped fluid and compare NPSHa for each respective centrifugal pump in operation of the group to a sum of an NPSH margin plus the NPSHr as calculated via the equation for each respective centrifugal pump in operation of the group, wherein the control system to automatically shut down a centrifugal pump in the group in response to the NPSHa for that centrifugal pump being equal to or less than the sum.

The details of one or more implementations are set forth in the accompanying drawings and the description below. Other features and advantages will be apparent from the description and drawings, and from the claims.

BRIEF DESCRIPTION OF DRAWINGS

Like reference numbers and designations in the various drawings indicate like elements.

DETAILED DESCRIPTION

Figure 1:
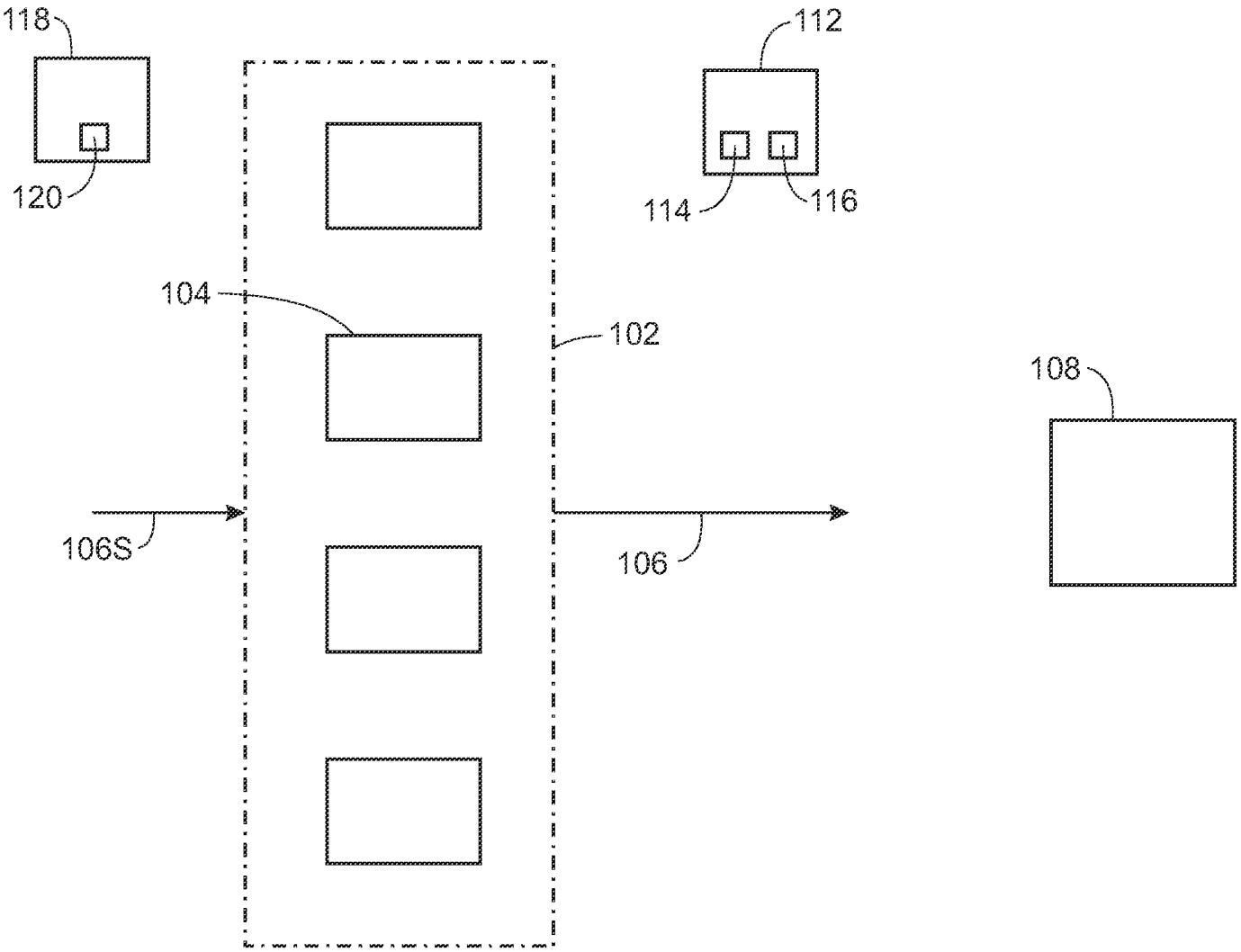
FIG. 1 and FIG. 2 are each a block diagram of a system having a designated group of centrifugal pumps.

Some aspects of the present disclosure are directed to an applied mathematical technique related to net positive suction head (NPSH) to avoid both cavitation and unnecessary trips (intentional shutdowns) of centrifugal pumps. An unnecessary trip may be an unneeded emergency shutdown (ESD) trip of the centrifugal pump.

In embodiments of the present techniques, an equation for NPSH required (NPSHr) for multiple centrifugal pumps collectively in a system may be derived from (fitted to) pump manufacturer NPSHr data that is a function of flowrate. Then, in operation, the NPSHr may be determined (calculated) via the derived equation for each centrifugal pump in the group of the multiple centrifugal pumps.

Cavitation may be expected to occur when NPSH available (NPSHa) falls below NPSHr. Thus, a NPSH margin (e.g., 1 meter) for NPSHa above NPSHr may be specified as a protection. The NPSH margin may be the difference of NPSHa determined by a control system minus NPSHr determined via the derived equation by the control system.

The system may be configured to trip (automatically shut down) a given pump of the multiple pumps if the actual NPSH margin is not at least the specified NPSH margin. The specified NPSH margin (as a minimum) is not satisfied when the NPSHa is less than the sum of the NPSHr calculated (by the derived equation) plus the specified NPSH margin. Such a scenario can cause an automatic shutdown of the centrifugal pump. The system can be configured automatically to shut down the centrifugal pump in response to the specified NPSH margin not satisfied and with the determination incorporating an NPSHr value(s) calculated with the derived equation.

An advantage may be more accurate implementation of trips when needed, as compared to other techniques that specify an arbitrary constant value for NPSHr (independent of flowrate) that give unnecessary trips at low flowrates and do not implement needed trips (to avoid cavitation) at high flowrates. An unnecessary trip may be an automatic shutdown of the pump when the pump is not experiencing cavitation nor on the verge of experiencing cavitation.

An Example presented below is the technique as implemented on twenty boiler feedwater (BFW) pumps collectively in a common power system having several power units (also called power blocks) at a refinery complex facility. In the Example, the pump manufacturer data utilized to derive the equation was the worst case (greatest NPSHr) of the twenty pumps from the Factory Acceptance Test (FAT) NPSHr curves for respective flowrates. The NPSH margin specified as protection was 1 meter.

An embodiment is a system including a group of centrifugal pumps specified collectively for control via an equation correlating NPSHr of the group with flowrate of pumped fluid based on manufacturer data. In this embodiment, the manufacturer data includes FAT data of the centrifugal pumps. The FAT data gives the NPSHr for each centrifugal pump of the group as a function of the flowrate of the pumped fluid. The NPSHr of the FAT data at a given flowrate of the pumped fluid varies among the centrifugal pumps of the group. The aforementioned equation (e.g., an equation having exponential form) may correlate select values of the NPSHr of the FAT data with the flowrate of the pumped fluid (e.g., liquid water). The select values may include average values, median values, or maximum values, or massaged values thereof, of the NPSHr of the FAT data among the centrifugal pumps in the group at differing flowrates of the pumped fluid. The system includes a control system to calculate, via the equation, the NPSHr for each centrifugal pump in operation of the group at a respective operating flowrate of the pumped fluid. The control system compares NPSHa for each respective centrifugal pump in operation of the group to a sum of the NPSH margin as specified (e.g., at least 0.5 meter specified as protection) plus the NPSHr as calculated via the equation for each respective centrifugal pump in operation of the group. The control system automatically shuts down a centrifugal pump in the group in response to the NPSHa for that centrifugal pump being equal to or less than the sum of the specified NPSH margin plus the NPSHr as calculated. The control system may be configured to determine the NPSHa. In implementations, the centrifugal pumps in the group are boiler feedwater pumps, and the pumped fluid is boiler feedwater. The system may include a boiler to receive boiler feedwater pumped by a centrifugal pump of the group of centrifugal pumps. In implementations, a heat recovery steam generator (HRSG) may include or be the boiler. In implementations, the system is a power plant.

FIG. 1 is a system 100 having a designated group 102 of centrifugal pumps 104. In the illustrated embodiment, the group 102 is depicted as having four centrifugal pumps 104. However, the designated group 102 can have more than four centrifugal pumps. The number of centrifugal pumps in a designated (specified) group can be at least 2 or at least 4, or in the ranges, for example, of 2 centrifugal pumps to 100 centrifugal pumps, or 4 centrifugal pumps to 60 centrifugal pumps. The number of centrifugal pumps 104 in the group 102 may depend on the number of users of the fluid being pumped, as well as the number of centrifugal pumps at the facility that pump the same or similar fluid and that have the same or similar manufacturer and model designation, and other factors. In implementations, the pumps 104 in the group 102 may generally pump the same type of fluid.

The fluid pumped by the centrifugal pumps 104 in the group 102 discharges pumped fluid 106 as one or more streams of from the group 102 to one or more users 108 of the pumped fluid 106. The pumped fluid 106 may generally be a liquid. The pumped fluid 106 can include a reactant(s), intermediate product, product, heat transfer fluid, water, chemical(s), and so forth.

In implementations, the multiple users 108 may be at the same site or facility at which the group 102 of pumps 102 is situated. In other implementations, one or more of the users 108 may be offsite. The users 108 can include industrial, commercial, and residential users. The users 108 can be or include various different unit operations. The users 108 can be or include a reactor vessel, distillation column, stripper column, absorber column, heat exchanger, boiler, and so on. The heat exchanger (if a user) may be, for example, a shell-and-tube heat exchanger, plate heat exchanger, plate-and-frame heat exchanger, plate-fin heat exchanger, or other type of heat exchanger. In implementations, the pumped fluid 106 is water and the user 108 is a consumer of the water. In some implementations, a user 108 is or includes an HRSG.

The group 102 receives one or more streams of the suction fluid 106S from one or more sources (not shown) to be pumped as the pumped fluid 106 to the user(s) 108. The source(s) may provide a fresh supply of the fluid 106S or a processed supply of the fluid 106S. In some embodiments, the fluid 106S may be a recycle from the user(s) 108. The fluid 106S may be generally the same in composition as the pumped fluid 106 discharged from the group 102. Again, the fluid 106S/106 is typically liquid or predominantly liquid.

NPSH may be the total suction head in meters (or feet) of liquid, less the vapor pressure (in meters or feet) of the liquid being pumped. NPSHa is generally determined or calculated based on the configuration and operation conditions on the suction side of the pumps 104. NPSHa may be independent of the configuration and operation conditions of the discharge side of the pumps 104. NPSHa is also typically independent of the pumps 104, except for the position (e.g., elevation of the pump centerline) of the pump with respect to the suction system that supplies the suction fluid 106S. NPSHa may be the amount of NPSH that the system has available at the pump inlet (or eye of the pump impeller). NPSHa is generally a function of the physical properties and operating conditions of the supplied liquid, and the suction system design and geometry. NPSHa can vary with flowrate of the liquid. Again, the NPSHa calculation can be based on the suction system and independent of the pump itself. The NPSHa can be thought of as the pressure or head of the fluid 106S at the pump 104 inlet (or pump 104 impeller eye) minus the vapor pressure of the fluid 106S at the temperature of the fluid at the pump 104 inlet or suction portion (or impeller eye). Typically, the NPSHa is given in units of height (e.g., meters or feet) as head, which can be converted to units of pressure (e.g., pounds per square inch absolute) if the specific gravity of the fluid is known.

The determination or calculation of the NPSHa may consider factors such as the absolute pressure at the surface of supply liquid (e.g., expressed in head), the vertical distance from the surface of the supply liquid to the centerline of the pump (can be positive or negative, typically expressed in meters or feet of head), friction losses in the suction supply piping, absolute vapor pressure of the liquid at pumping temperature, and the like. An example calculation may be NPSHa is equal to the sum of the absolute pressure at surface and (+/−) the vertical distance minus friction losses and minus the absolute vapor pressure. The velocity head (e.g., at the pump suction port) may added to increase NPSHa in the calculation, but the velocity head is commonly negligible. The velocity head $[v^2/(2\ g)]$ is the square of the velocity of the liquid divided by two and divided by the gravitational constant. Other example calculations or determinations of NPSHa are applicable. NPSHa can be determined via measurements on the suction-side system in comparison to the vapor pressure of the liquid. In sum, NPSHa may be a system property calculated based on the suction-side system configuration, and can be generally characterized as the suction-side pressure less the vapor pressure of the pumped fluid at that point. NPSHa should exceed the NPSHr rating of the pump 104 for the chosen operating conditions to advance that pump cavitation is avoided. Normally, a margin, such as at least 0.5 m or at least 1 m, is implemented. This NPSH margin is a protection factor (margin) by which NPSHa should exceed NPSHr to avoid cavitation of the centrifugal pump.

NPSHr is a pump property. NPSHr may be reported by the pump manufacturer based on testing of the pump under controlled conditions. NPSHr may be a minimum suction pressure or head that should be exceeded for the centrifugal pump to operate correctly and avoid flashing and cavitation. Manufacturers may test centrifugal pumps under conditions of constant flow and observe the discharge pressure (differential head) as NPSH (the suction pressure) is gradually reduced. Tests may be performed, for example, with water at 20° C. NPSHr is generally a function of the flowrate of the pumped fluid. In some implementations, NPSHr can be specified by the pump manufacturer, for instance, as the value at which the pump discharge pressure is reduced by 3% because of the onset of cavitation The documentation supplied by the pump manufacturer with a centrifugal pump may include a pump curve (pump performance curve) or pump curves. The pump curves may be multiple curves relating manufacturer data of the pump. The pump curves may include a chart depicting how the pump head pressure varies with flowrate of the pumped liquid. The pump curves may also depict how pump power consumption and efficiency vary with flowrate of the pumped fluid. In some cases, an NPSHr chart (curve) may be incorporated into the pump curves for a model (or family of multiple models) of pumps with a range of impeller sizes. Although pump performance is generally different for each impeller size and thus giving separate pump curves for pump head and efficiency, NPSHr may be essentially the same for a family or model of centrifugal pumps within the given range of impeller sizes. Therefore, a single NPSHr chart (curve) may be depicted on the pump curves for that model (or family of models) of centrifugal pumps. If such is not the case, the manufacturer can provide separate NPSHr charts (curves) for each pump model in the family or for each sub-model or significant variation of the pump model.

Factory acceptance tests (FAT) performed by the pump manufacturer on individual centrifugal pumps may give manufacturer data unique for each individual centrifugal pump tested. In other words, the FAT data is for a single given pump and not for a model or family of pumps as with the pump performance curves. The FAT as a centrifugal pump performance test may be conducted by the pump manufacturer after completion of the assembly of the pump to prove the pump has the required specification as indicated in the pump datasheet and other purchase documents.

The FAT manufacturer data may include an NPSHr curve that is NPSHr as a function of flowrate of the pumped fluid (liquid). The FAT NPSHr curve for that individual centrifugal pump may deviate (vary) from the NPSHr curve given on the pump performance curves for the model or family of the individual centrifugal pump. Again, the FAT of a centrifugal pump may refer to the functional test that is performed by the manufacturer or vendor upon completion of the manufacturing process to prove the equipment has the same specification and functionality indicated on the pump datasheet, specification, and purchase order. The test typically may be witnessed by the third party inspector and/or customer (purchaser) representative.

Embodiments of the present techniques designate a group of centrifugal pumps (e.g., at least four centrifugal pumps of the same or similar model) in a system and generate or specify an equation (e.g., a single equation) for the group based on manufacturer data of the centrifugal pumps collectively in the group. The manufacturer data may give NPSHr for the centrifugal pumps of the group as a function of the flowrate of the pumped fluid. The equation derived or specified may correlate NPSHr with flowrate of pumped fluid. The equation can be, for example, the NPSHr curve provided by the manufacturer for the family or model on the pump performance curves, or a modified version thereof. On the other hand, the manufacturer data may give NPSHr at a given flowrate of the pumped fluid that varies vary among the centrifugal pumps of the group.

For instance, the equation may be based on the manufacturer FAT NPSH curve (data) of each individual pump in the group collectively. The manufacturer data may include FAT data that gives the NPSHr for each centrifugal pump 104 of the group 102 as a function of the flowrate of the pumped fluid based on FAT performed on each centrifugal pump 104 of the group 102. Embodiments of the present techniques may include, for example, generating the equation (e.g., single equation) for the designated group 102 based on the FAT NPSHr values that are average, median, or maximum of the FAT data among the centrifugal pumps 104 in the group 102 at respective differing flowrates of the pumped fluid and fitting the NPSHr values as selected to give the equation. For illustrative purposes, manufacturer FAT NPSHr data for four of the centrifugal pumps from the actual Example below are given in Table 1. In Table 1, the four pumps are arbitrarily labeled hypothetically as first pump 104, second pump 104, third pump 104, and fourth pump 104 of the group 102. Table 1 gives NPSHr in meters (m) as function of volumetric flowrate in cubic meters per hour ($m^3$/h). Table 1 also gives the minimum, average, and maximum values of NPSHr of the four pumps 104 at each flowrate.

TABLE 1

FAT NPSHr data taken from Example

| Flowrate ($m^3$/h) | 250 | 490 | 550 | 730 | 800 | 887 | 935 | 970 |
|---|---|---|---|---|---|---|---|---|
| $1^{st}$ pump 104 NPSHr (m) | 7 | 9 | 9.2 | 11.5 | 13 | 16.5 | 20 | 23.5 |
| $2^{nd}$ pump 104 NPSHr (m) | 8 | 9 | 9.9 | 12 | 13.5 | 17.8 | 21 | 25 |
| $3^{rd}$ pump 104 NPSHr (m) | 8 | 9 | 9.5 | 11 | 13 | 16 | 20 | 24 |
| $4^{th}$ pump 104 NPSHr (m) | 7 | 7.5 | 8 | 11.5 | 13 | 16 | 18 | 20 |
| Minimum (m) | 7 | 7.5 | 8 | 11 | 13 | 16 | 18 | 20 |
| Average (m) | 7.5 | 8.6 | 9.2 | 11.5 | 13.1 | 16.6 | 19.8 | 23.1 |
| Maximum (m) | 8 | 9 | 9.9 | 12 | 13.5 | 17.8 | 21 | 25 |

With reference to the depiction in Table 1, the derived NPSHr equation (as a function of flowrate) for the group 102 may be based on the NPSHr minimum values of the FAT data of the four pumps 104. The minimum values of NPSHr can be fitted to an equation as the equation for the group 102. Application of the equation based on these minimum values to the group 102 in operation can avoid unnecessary trips of the pumps 104 but could result in an excessive number of cavitation scenarios (e.g., for $2^{nd}$ pump 104) because the fitted values are minimum values. Fitting the average values of NPSHr of the FAT data instead to the equation would generally be more conservative with respect to avoiding cavitation among the pumps 104. Fitting the maximum values of NPSHr of the FAT data instead to the equation would generally be even more conservative for avoiding cavitation among the pumps 104 in the group 102. An advantage of basing the equation on average values can be less unnecessary trips as compared to implementation of the equation derived based on maximum values of NPSHr among the four pumps 204. However, basing the equation on the maximum values may beneficially avoid more instances in which the group 102 experiences cavitation, which can cause pump failure. Whether minimum values, median values, average values, maximum values, or other characterizations of the FAT NPSHr data are relied on for developing the derived equation may depend on the particular application.

Moreover, factors can be applied to the raw NPSHr values of the manufacturer FAT data. In other words, the FAT data can be massaged before fitting the data to the equation. For example, the average NPSHr values can be increased by a factor, or the maximum NPSHr values can be decreased by a factor. The factor may be, for example, in the range of 0.9 to 1.1. For instance, the average NPSHr values can be multiplied by the factor of 1.05 to give NPSH values for developing the equation. In another example, the maximum NPSHr values of the FAT data can be multiplied by a factor of 0.95 to give the NPSHr values for developing the equation. In lieu of, or in addition to, applying a factor to the FAT data, a factor can be applied to the NPSHr value determined by (calculated via) the equation in operation. The application of a factor may dependent on considerations such as the particular system and pumps, as well as the amount of risk of cavitation accepted, and the like.

In the application of the equation, a NPSH margin for NPSHa above the NPSHr may be specified. The technique may include calculating, via the equation (e.g., a single equation), the NPSHr for each centrifugal pump 104 in operation of the group 102 at a respective operating flowrate of the pumped fluid. A control system may compare the NPSHa for each respective centrifugal pump 104 in operation of the group 102 to the sum of the NPSH margin (as specified) plus the NPSHr as calculated via the equation for each respective centrifugal pump 104 in operation of the group 104. The technique may include shutting down a centrifugal pump 104 in operation of the group 102 in response to the NPSHa for that centrifugal pump 104 being less than the sum for that centrifugal pump 104.

The system 100 of FIG. 1 can be (or a sub-system at) a manufacturing facility, a commercial site, a chemical/petrochemical plant, an oil refinery, a natural gas processing plant, a pulp-and-paper manufacturing plant, a power plant, and so forth. In some implementations, the system 100 is a power plant or a power-generating portion of a larger production facility or complex. The power plant or power-generating portion may include multiple power units or power blocks.

The system 100 may include a control system 110 that may facilitate processes of the system 100 including to direct operation of the centrifugal pumps 104. The control system 110 may facilitate or direct operation of the system 100, such as with (1) operation of equipment generally and specifically the centrifugal pumps 104 and motor control, (2) supply or discharge of flow streams (including flowrate and pressure) and associated control valves, (3) receiving data from sensors (e.g., temperature, pressure, etc.) and online analytical instruments, (4) receiving input including constraints from users, (5) performing calculations, (6) specifying set points for control devices, and so forth. The control system 110 may determine, calculate, and specify the set point of control devices, and make other control decisions such as whether to stop or start a centrifugal pump 104. The determinations can be based on calculations performed by the control system and on operating conditions of the system 100 including feedback information from sensors and instrument transmitters, and the like. The control system 110 may receive user input that specifies the set points of control devices or other control components in the system 100. The control system 110 typically includes a user interface for a human to enter set points and other targets or constraints to the control system 110. The control system 110 may be communicatively coupled to a remote computing system that performs calculations and provides direction including values for set points.

The control system 110 may be disposed remotely in a control room, or disposed in the field such as with control modules and apparatuses distributed in the field. The control system 110 may include a desktop computer, laptop computer, computer server, programmable logic controller (PLC), distributed computing system (DSC), controllers, actuators, or control cards. The control system 110 may include a processor 112 and memory 114 storing code (e.g., logic, instructions, etc.) executed by the processor 112 to perform calculations and direct operations of the system 100. The processor 112 (hardware processor) may be one or more processors and each processor may have one or more cores. The hardware processor(s) may include a microprocessor, a central processing unit (CPU), a graphic processing unit (GPU), a controller card, circuit board, or other circuitry. The memory 114 may include volatile memory (e.g., cache and random access memory), nonvolatile memory (e.g., hard drive, solid-state drive, and read-only memory), and firmware.

The control system 110 may calculate NPSHa and NPSHr for the centrifugal pumps 104 in the group 102, and for other centrifugal pumps in the system 100. The parameters and procedure for determination of NPSHa and NPSHr (including the derived equation for NPSHr of the group 102) may be stored as code in the memory 114 and executed by the processor 112. The control system 110 may automatically shut down and automatically start the centrifugal pumps 104. Some implementations may include a control room that can be a center of activity, facilitating monitoring and control of the process or facility. The control room may contain a human machine interface (HMI), which is a computer, for example, that runs specialized software to provide a user-interface for the control system. The HMI may vary by vendor and present the user with a graphical version of the remote process. There may be multiple HMI consoles or workstations, with varying degrees of access to data. The control system 110 can be a component of the control system based in the control room. The control system 110 may also or instead employ local control (e.g., distributed controllers, local control panels, etc.) distributed in the system 100.

The system 100 may include a motor control center (MCC) 116 or similar configuration or assembly. The MCC 116 may be an assembly of devices 118 to control electric motors in the system 100. The MCC 116 may receive electricity from switchboards, panelboards, transformers, etc. and feed the electricity to motor circuits, such as for the motors of the centrifugal pumps 104. The devices 118 may include controllers, relays, combination starters, and other devices to centralize motor control operations while protecting individual motor circuits. The combination starters may include a motor starter, fuses or circuit breaker, and power disconnect. The MCC 116 can include push buttons, indicator lights, variable-frequency drives, programmable logic controllers, and metering equipment. The control system 110 may interface with the MCC 116 to automatically stop or automatically start the centrifugal pumps 104. Other configurations not involving the MCC 116 are applicable to automatically stopping or starting the centrifugal pumps 104.

Figure 2:
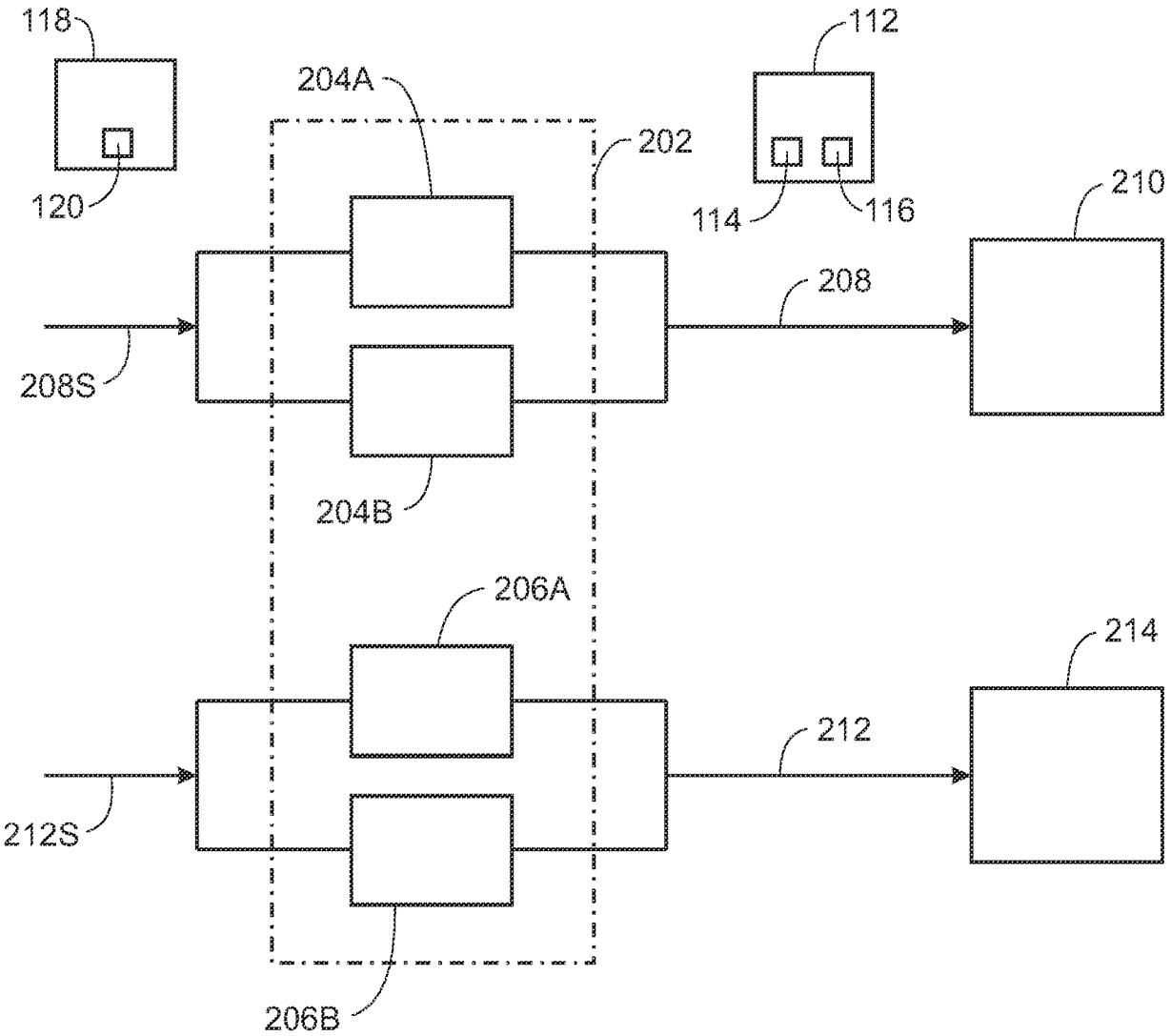

FIG. 2 is a system 200 that may be similar to the system 100 of FIG. 1. The system 200 includes a designated (identified, specified) group 202 of four centrifugal pumps 204A, 204B, 206A, and 206B. The group 202 may include more than four centrifugal pumps, as discussed with respect to group 102 of FIG. 1. In the illustrated embodiment of FIG. 2, the pumps 204A and 204B are sister pumps. In other words, in general, only one of the pumps 204A and 204B is in operation at a given time. The pump 204B or 204B not in operation at the given time is considered a spare pump ready for operation.

While the pump 204A is in operation, the pump 204B is not in operation but is available as a spare to be started and placed in operation if the pump 204A is shut down. Likewise, while the pump 204B is in operation, the pump 204A is not in operation but is available as a spare to be started and placed in operation if the pump 204B is shutdown. The two pumps 206A and 206B are also sister pumps with respect to each other.

The pumps 204A, 204B receive a feed or suction fluid 208S and pump the fluid 208S as pumped fluid 208 as discharge to a first user 210. The fluids 208S and 208 are generally the same fluid in that the composition of the fluid typically does not change through the pump. The pumps 206A, 206B receive a feed or suction fluid 212S and pump the fluid 212S as pumped fluid 212 as discharge to a second user 214. The fluids 212S and 212 are also generally the same fluid in that the composition of the fluid typically does not change through the pump. The fluids 208S, 208, 212S, and 212 may generally be liquid.

As discussed with respect to FIG. 1, the pumped fluid 208 and 212 can include a reactant(s), intermediate product, product, heat transfer fluid, water, chemical(s), processed fluid, and so forth. In implementations, the users 210 and 214 may be at the same site or facility at which the group 202 is disposed. In other implementations, one or both of the users 210 and 214 may be offsite. The users 210 and 214 can be as characterized as described for the users 108 of FIG. 1.

Embodiments of the present method may include grouping multiple centrifugal pumps (e.g., 204A, 204B, 206A, 206B) in a system (e.g., 200) for application of an equation (the aforementioned equation derived for a group based on manufacturer data) to the multiple centrifugal pumps. As discussed, the equation gives NPSHr as a function of flowrate of the pumped fluid. The method includes developing the equation based collectively on manufacturer data of each centrifugal pump of the multiple centrifugal pumps, wherein the manufacturer data varies respectively among the multiple centrifugal pumps. The manufacturer data may correlate NPSHr with the flowrate of the pumped fluid. The manufacturer data may include FAT data for each centrifugal pump of the multiple centrifugal pumps, the FAT data giving NPSHr for each centrifugal pump of the multiple centrifugal pumps as a function of the flowrate of the pumped fluid. The developing of the equation based collectively on manufacturer data of each centrifugal pump of the multiple centrifugal pumps may involve selecting NPSHr values that are average, median, or maximum of the FAT data of the multiple centrifugal pumps at respective differing flowrates, and deriving the equation with the NPSHr values as selected. The equation developed may be an exponential equation.

The method includes specifying as a protection an NPSH margin for NPSH available (NPSHa) above the NPSHr. The NPSH margin specified may be, for example, at least 0.5 m, at least 0.8 m, at least 1 m, at least 1.2 m, at least 1.5 m, at least 1.8 m, or at least 2 m. The NPSH margin specified may be in the range, for example, of 0.5 to 2. The method may include: calculating, via the equation, the NPSHr for each centrifugal pump in operation of the multiple centrifugal pumps; determining the NPSHa for each centrifugal pump in operation of the multiple centrifugal pumps; and comparing the NPSHa for each respective centrifugal pump in operation of the multiple centrifugal pumps to the NPSHr as calculated via the equation for each respective centrifugal pump in operation of the multiple centrifugal pumps. The method may include shutting down a centrifugal pump of the multiple centrifugal pumps in response to the NPSHa for that centrifugal pump being less than a sum of the NPSHr calculated via the equation for that centrifugal pump plus the NPSH margin as specified. Lastly, for a user (e.g., 210, 214) that is a boiler, the method may include pumping boiler feedwater as a pumped fluid from the group (e.g., 202) to the boiler.

In FIG. 1, the one or more users 108 may be or include a boiler. Likewise, in FIG. 2, the users 210, 212 may also be or include a boiler. Therefore, the pumped fluid 106, 208, 212 from the groups 102, 202 may include liquid water (e.g., demineralized water, boiler feedwater, steam condensate, etc.) to be evaporated by the boiler to give steam. In such implementations, this feed water (pumped fluid 106, 208, 212) to the boiler may be boiler feedwater that may be treated water including demineralized water and can include steam condensate, and the like. The pumped boiler feedwater may be a combination of fresh boiler feedwater (e.g., demineralized water plus treatment additives) and recycled boiler feedwater as steam condensate from the boiler. In some instances, the centrifugal pumps in the groups 102, 202 may be labeled as boiler feedwater pumps. The boiler can be an HRSG in some implementations. An HRSG can be associated with or part of a combined cycle, such as a Brayton-Rankine combined cycle.

The present techniques of deriving and applying the aforementioned equation to more precisely avoid pump cavitation may be especially beneficial for boiler feedwater pumps because the boiler feedwater provided to the pumps tends to be near its vapor pressure. The temperature of the boiler feedwater may be not be far below the condensation (vaporization) temperature of the boiler feedwater. The boiler feedwater may be relatively high temperature giving higher vapor pressure of the water, resulting in less NPSHa. In general, a basis for deciding whether to group centrifugal pumps for application of the equation (derived collectively for the group based on manufacturer data of individual pumps in the group) may be when the pump inlet operates close to the vapor pressure of the fluid. Whether the pumped fluid is boiler feedwater or other liquid, a criterion in determining whether to group centrifugal pumps to control in deciding when to trip the pump via the aforementioned equation may include, for instance, the pumps operating with the pumped fluid at the pump inlet (suction) within, for example, 10% of the absolute vapor pressure of the pumped fluid.

A boiler may be called a steam generator. A boiler may generate steam by applying heat to water to evaporate the water to give the vaporized water as steam. A boiler may include a burner, controls, deaerator, economizer, fan, heat exchanger, instrumentation, stoker, tubes, and so on. The boiler may be, for example, a water tube boiler or a fire tube boiler. In some implementations, the boiler feedwater may be provided from the feedwater pump (centrifugal pump) to a steam drum in the boiler. The heat applied in the boiler to increase the temperature of the feed water to evaporate the water may be provided, for example, via a furnace, combustion gas, waste gas, and the like. For instances with the steam generated as saturated steam, the steam may heated to give superheated steam. The steam generated by the boiler may be employed as a heating medium or instead drive a turbine to generate electricity, and so forth. Boilers in a power plant or power generating section of a facility tend to be a water tube boiler (in which the water being evaporated is on the tube side), and the steam produced drives a steam turbine or gas turbine to generate electricity.

In FIG. 2, the users 210, 212 may be or include an HRSG. Likewise, in FIG. 1, the one or more users 108 may also be or include an HRSG. Therefore, the pumped fluid 106, 208, 212 from the groups 102, 202 may include treated liquid water (e.g., demineralized water, boiler feedwater, steam condensate, etc.) to be evaporated by the HRSG to give steam. An HRSG may be called an HRSG boiler. An HRSG may be labeled as a boiler or as including a boiler.

Figure 3:
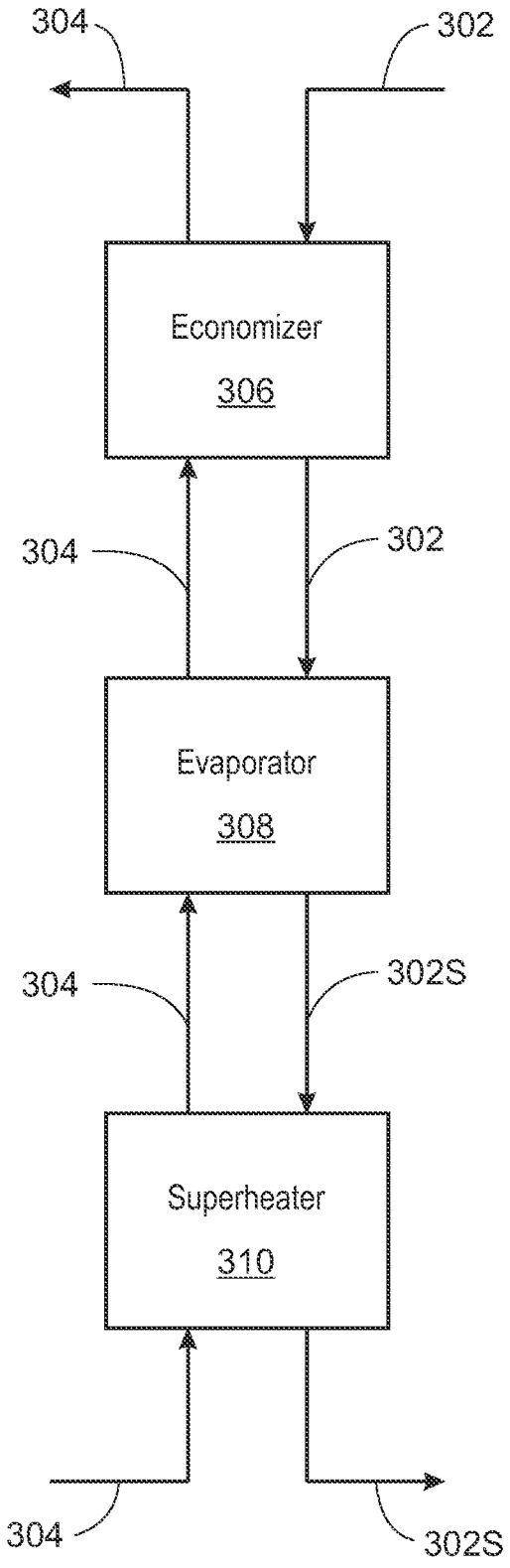
FIG. 3 is a diagram of a simplified representation of a heat recovery steam generator (HRSG).

FIG. 3 is a simplified representation of an HRSG 300. In some implementations, the HRSG 300 may be associated with (or a component of) a combined cycle (e.g., Brayton-Rankine). In certain embodiments, a user 108 (FIG. 1) or a user 210, 212 (FIG. 2) may be or include the HRSG 300. For embodiments in which the group 102 of FIG. 1 or the group 202 of FIG. 2 is boiler feedwater pumps for the HRSG 300, the boiler feedwater 302 provided to the HRSG 300 may be the pumped fluid 106, 108, or 112.

The HRSG 300 recovers heat from a hot gas stream (e.g., combustion gas 304) to heat the boiler feedwater 302 to produce steam 302S. The produced steam 302S may be, for example, utilized in a process (e.g., cogeneration) or utilized to drive a steam turbine (e.g., in a combined cycle), and the like. The HRSG 300 may overall be called a heat exchanger. The HRSG 300 may generally be a vessel(s) having heat exchangers (e.g., 306, 308, 310) and in which the boiler feedwater 302 flows through tubes and combustion gas 304 flows through the vessel around the exterior of the tubes. Heat transfer occurs from the combustion gas 304 outside of the tubes through the tube wall to the boiler feedwater 302 in the tubes. In the heat exchange, the boiler feedwater 302 is heated and the combustion gas 304 is cooled.

The combustion gas 304 (e.g., flue gas or waste gas) is provided to the HRSG 300 as a heating medium. The combustion gas 304 may be from a furnace that burns fuel in the presence of air to give the combustion gas 304.

The HRSG 300 includes an economizer 306, evaporator 308, and superheater 310, among other components. The boiler feedwater 302 and the combustion gas 304 may generally flow in a counter current flow with respect to each other through the HRSG 300.

The boiler feedwater 302 is provided to the economizer 306 that heats the boiler feedwater 302 with the combustion gas 304. In some implementations, the boiler feedwater 302 may be pre-heated in a heat exchanger (upstream of the HRSG 300) prior to entry to the economizer 306 of the HRSG 300.

The economizer 306 may be, for example, of vertical design or horizontal design. While the economizer 306 may be of a shell-and-tube type with the vessel (e.g., duct) essentially as a shell, the economizer 306 in an HRSG may include fins or finned tubes. Economizer tubes may arranged horizontally in a vertical HRSG (exhaust flows vertically) and vertically in a horizontal HRSG (exhaust flows horizontally). Horizontal HRSGs may also have a horizontal tube arrangement, such as when the width of the HRSG is greater than the height of the HRSG.

In operation, the economizer 306 may heat the boiler feedwater 302 but typically not above the boiling point of the boiler feedwater 302. The heated boiler feedwater 302 may flow from the economizer 306 to the evaporator 308 of the HRSG 300. Again, the flow of the boiler feedwater 302 is typically counter current with the combustion gas 302 (heating medium).

The evaporator 308 is a heat exchanger that converts the liquid boiler feedwater 302 into steam 302S that may be saturated steam. The evaporator 308 may be called a steam generator or a boiler. The evaporator 308 may be a heat exchanger having tubes in which the boiler feedwater 302 flows through the tubes. The HRSG 300 vessel (e.g., duct, housing, pressure vessel, etc.) or other vessel may enclose the evaporator 308 tubes. The combustion gas 304 may flow in the evaporator 308 through the vessel around the tubes. In the evaporator 308, the boiler feedwater 302 is heated with the combustion gas 304 to evaporate the boiler feedwater 302 into steam. Steam 302S discharges from the evaporator 308. A steam drum (not shown) may be associated with (or included as a component of) the evaporator 306. The upstream boiler feedwater 302 as heated by the economizer 306 may be fed from the economizer 306 to the steam drum as feed to the evaporator 308. The steam 302S (e.g., saturated) may discharge from the steam drum as discharge from the evaporator 308 to the superheater 310.

The superheater 310 may be a heat exchanger that heats the entering steam 302S to increase the steam to above its saturation temperature to discharge the steam 302S as superheated. In other words, the superheater 310 as a heat exchanger may receive saturated steam 302S from the evaporator 308 and discharge superheated steam 302S. The superheater 310 may heat the steam 302S with the combustion gas 304. The superheater 310 may have tubes in which in operation, the steam 302S is inside the tubes. Heat transfer in the superheater 310 may occur from the combustion gas 304 on the exterior side of the tubes through the tube wall to the steam 302S in the tubes. The superheater 310 may discharge the superheated steam 302 to drive a steam turbine (e.g., to generate electricity in a combined cycle) or for other applications.

Figure 4:
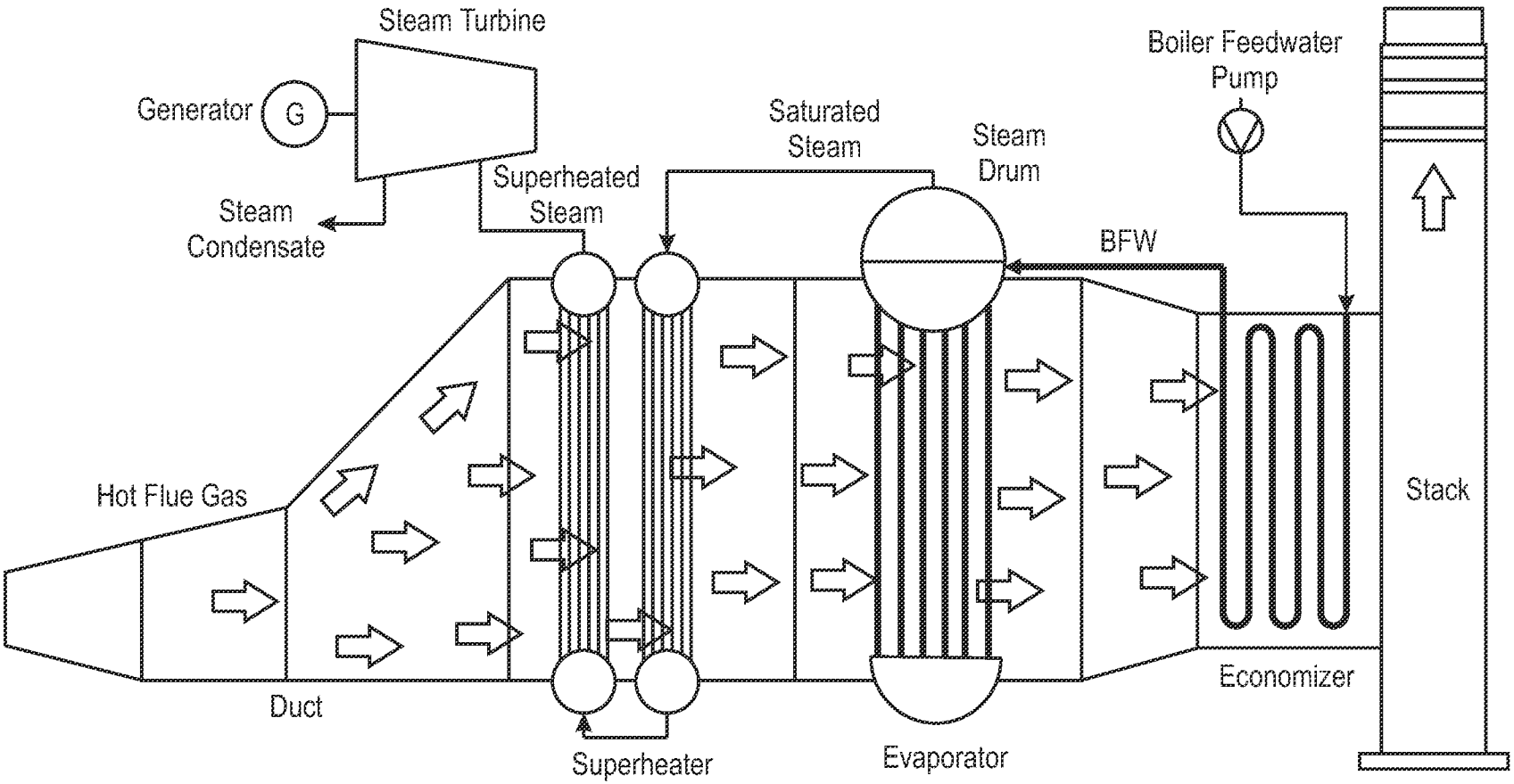
FIG. 4 is a diagram of an HRSG.

FIG. 4 is an HRSG 400 that may be the same or similar as the HRSG 300 of FIG. 3. The depiction of the HRSG 400 is given as one implementation and not intended to limit the present techniques.

The HRSG 400 (and HRSG 300) may be or in a power block (power unit) in a power plant or power-generation portion of a facility. There may be multiple power blocks (each or some having an HRSG) in the power plant or power-generation section of a facility. The Example below is directed to such a configuration in which a power plant (power-generation systems) having multiple power blocks each with an HRSG is situated in a facility that is a petrochemical refinery complex.

In FIG. 4, combustion gas (hot flue gas) is received at the front end of the HRSG 400 from, for example, a furnace that generates the combustion gas. In some implementations of a combined cycle, the hot flue gas may be received from a turbine (e.g., gas turbine) and with the combustion apparatus (e.g., furnace) upstream of the turbine that feeds the hot flue gas to the turbine.

For the HRSG 400, the flue gas flows across the superheater, the evaporator, and the economizer in that order, and discharges through a stack (e.g., flue gas stack) to the environment in the illustrated embodiment. The flue gas may be treated at the stack discharge portion prior to discharge.

A boiler feedwater pump is depicted as providing boiler feedwater to the tubes of the economizer of the HRSG 400. The boiler feedwater (warm BFW) as heated by the economizer flows to the steam drum of the evaporator that vaporizes the liquid boiler feedwater give saturated steam. The evaporator discharges the saturated steam to the superheater that superheats the steam. In the illustrated implementation, the superheater discharges the superheated steam to a steam turbine, as might be implemented with a combined cycle. The superheated steam drives the steam turbine to generated electricity via a generator coupled to the steam turbine. The superheated steam is condensed via the steam turbine and/or via a downstream condenser heat exchanger to give steam condensate. Some of the steam condensate may be recycled as boiler feedwater for pumping by the boiler feedwater pump.

In one embodiment for FIG. 2, the first user 210 is a first HRSG 400. The pumped fluid 208 is the boiler feedwater provided to the first HRSG 400. The sister centrifugal pumps 204A, 204B are boiler feedwater pumps with one in operation and the other as a spare, and in which pump (as the boiler feedwater pump depicted in FIG. 4) the boiler feedwater to the economizer of the first HRSG 400. In this embodiment, the second user 214 is a second HRSG 400. The pumped fluid 212 is the boiler feedwater provided to the second HRSG 400. The sister centrifugal pumps 206A, 206B are boiler feedwater pumps with one in operation and the other as a spare, and in which pump (as the boiler feedwater pump depicted in FIG. 4) the boiler feedwater to the economizer of the second HRSG 400. Steam condensate from the combined cycle associated the first HRSG 400 may be recycled as boiler feedwater (as inlet fluid 208S) for pumping by the sister centrifugal pumps 204A, 204B. Likewise, the steam condensate from the combined cycle associated the second HRSG 400 may be recycled as boiler feedwater (as inlet fluid 212S) for pumping by the sister centrifugal pumps 206A, 206B. Therefore, depending on factors, such as the amount of subcooling of the steam condensate and the amount of fresh boiler feedwater (at lower temperature) incorporated into the inlet fluid 208S, 212S, the inlet fluid 208S, 212S may be relatively close to its vapor pressure. Thus, the application of the derived NPSHr equation (discussed above) for embodiments of the groups 202, 204 as boiler feedwater pumps may be beneficial.

Figure 5:
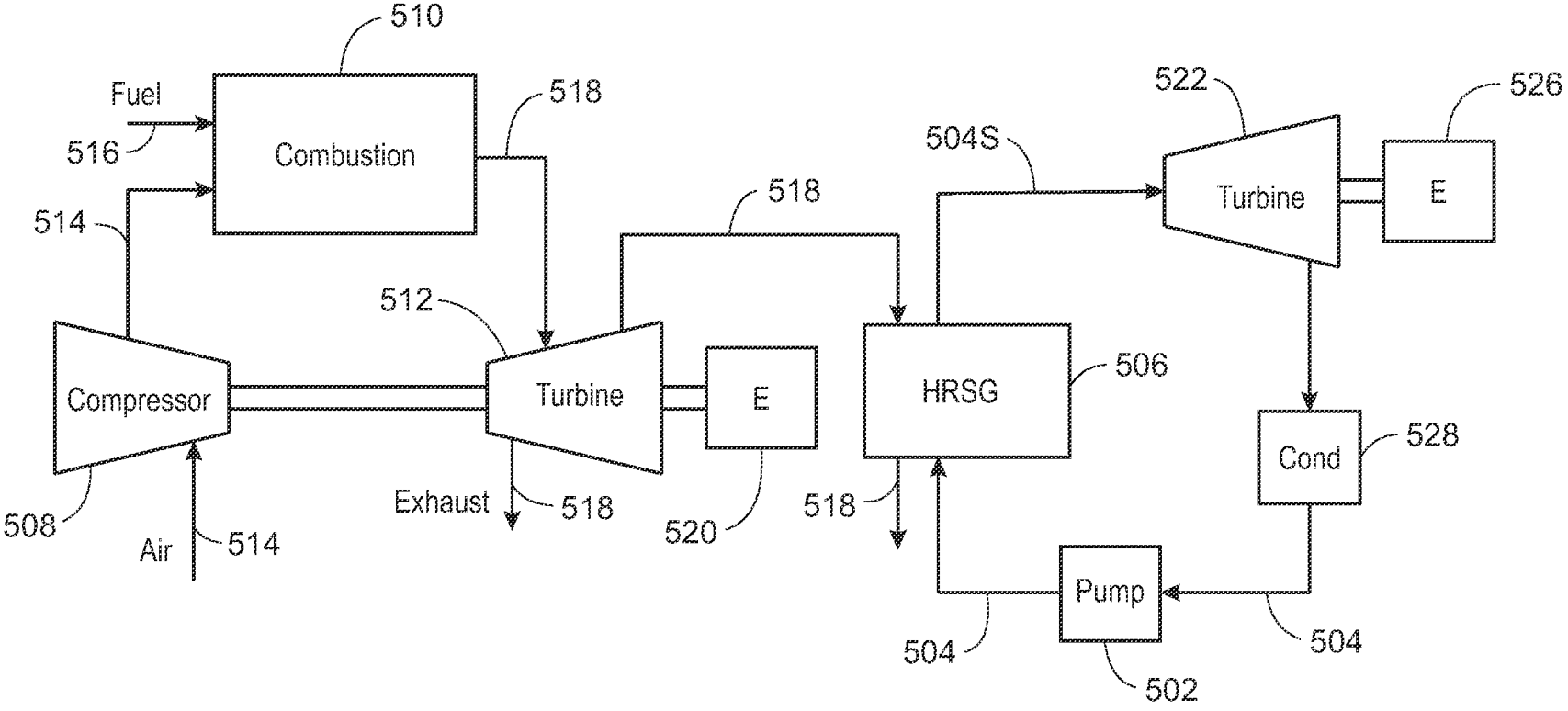
FIG. 5 is a diagram of a combined cycle that may employ an HRSG of FIGS. 3-4 and that can be a user in FIGS. 1-2.

FIG. 5 is a combined cycle 500 that may employ the HRSG 300, 400 (see FIGS. 3-4) and that can be a user 108, 210, 214 (see FIGS. 1-2). In the illustrated embodiment, the combined cycle 500 in particular as depicted is a Brayton-Rankine combined cycle, which combines the Brayton (gas turbine) and Rankine (steam turbine) thermodynamic cycles. The gas turbine (Brayton cycle) can be driven by combustion. The steam turbine (Rankine cycle) can be driven by steam generated with exhaust waste of the Brayton cycle combustion. The combined cycle 500 may be characterized as a power plant, a unit of power plant, or a power block. The combined cycle 500 includes (or relies on) a boiler feedwater pump 502 (a centrifugal pump) that provides boiler feedwater 504 to an HRSG 506 of the combined cycle 500. In some embodiments, the boiler feedwater pump 502 may be analogous to a centrifugal pump in the groups 102, 202, and the boiler feedwater 504 analogous to the pumped fluid 106, 208, 212 and boiler feedwater 302. See FIGS. 1-3.

The Brayton portion of the combined cycle 500 (Brayton-Rankine) may include an air compressor 508, combustion apparatus 510 (e.g., furnace), and gas turbine 512. In operation, air 514 is provided to the compressor 514 (e.g., a mechanical compressor). The compressor 514 discharges the air 514 as compressed to the combustion apparatus 510. Fuel 516 to be combusted is also fed to the combustion apparatus 510. The fuel 516 may include, for example, fossil fuels such as natural gas, diesel, oils, and kerosene. The fuel 516 may include renewable fuels, such as biodiesel or biogas. The combustion gas 518 discharged from the combustion apparatus 510 drives the gas turbine 512. In turn, the gas turbine 518 drives the compressor 508 and a gas-turbine generator 520 that generates electricity. A portion of the combustion gas 518 may discharge from the gas turbine 512 as exhaust. A portion of the combustion gas 518 may discharge to the HRSG 506 in the Rankine cycle part of the combined cycle 500.

The Rankine portion of the combined cycle 500 (Brayton-Rankine) may include the HRSG 506, steam turbine 522, and condenser 524 (heat exchanger). In operation, the HRSG 506 receives the combustion gas 518 and transfers heat from the combustion gas 518 to the boiler feedwater 504 to vaporize the boiler feedwater 504 into steam. The HRSG 506 may discharge the combustion gas 518, for example, to a flue stack. The HRSG 506 discharges steam 504S (e.g., superheated) to drive the steam turbine 522, which in turn drives the steam-turbine generator 526 that generates electricity. The steam turbine 522 discharges the steam 504S to the condenser 528. The condenser 528 heat exchanger (e.g., shell-and-tube heat exchanger) may employ a cooling medium (e.g., water, such as cooling tower water) to condense the steam. The condenser 528 heat exchanger may discharge the condensed steam (steam condensate) as boiler feedwater 504 to the boiler feedwater pump 502. Fresh boiler feedwater as makeup can be combined with the boiler feedwater 504 from the condenser 528.

Figure 6:
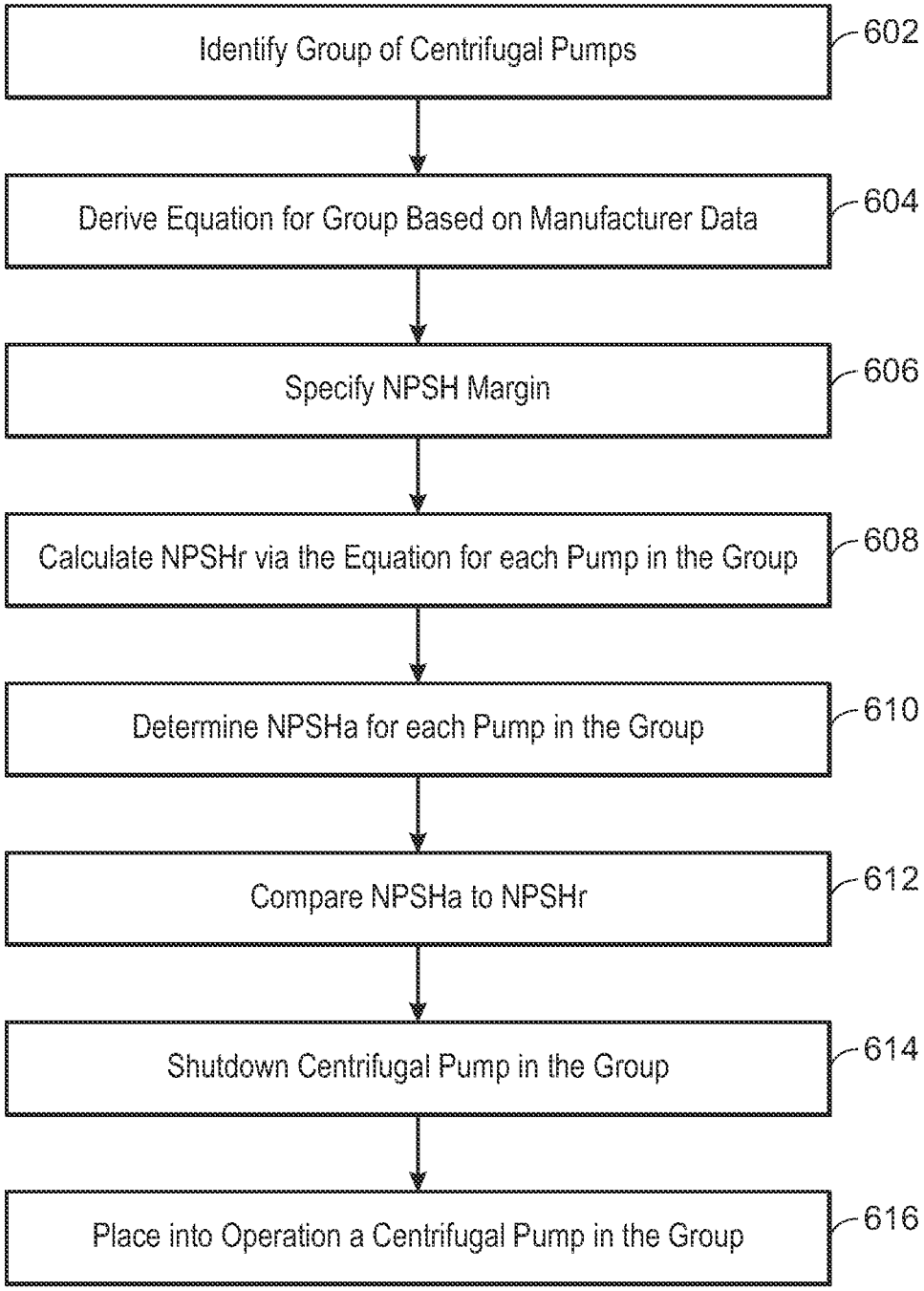
FIG. 6 is a block flow diagram of a method of operating centrifugal pumps.

FIG. 6 is a method 600 of operating centrifugal pumps. The method involves considering NPSH. In implementations, the method 600 may be directed to avoiding both cavitation and unnecessary trips (intentional shutdowns) of centrifugal pumps. In some implementations, the method relies on manufacturer data of the centrifugal pumps, such as pump FAT data relating NPSHr to the flowrate of the pumped fluid.

At block 602, the method includes identifying (designating, specifying) a group (collection) of centrifugal pumps in a system (e.g., system 100, 200 of FIGS. 1-2). A basis (criterion) for identifying a set of centrifugal pumps may be that the pumped fluid on the suction side of the pumps is close (e.g., within 10%) of the vapor pressure of the pumped fluid. As discussed, the number of centrifugal pumps identified for inclusion in the group can be at least 2 or at least 4, or in the ranges, for example, of 2 centrifugal pumps to 100 centrifugal pumps, or 4 centrifugal pumps to 60 centrifugal pumps. The number of centrifugal pumps in the group may depend on the number of users of the fluid being pumped. The number of centrifugal pumps in the group may depend on the number of centrifugal pumps at the facility that pump the same or similar fluid, and that have the same or similar manufacturer and model designation, and other factors. In implementations, the pumps in the group may typically pump the same fluid or same type of fluid same type of fluid. The pumped fluid is generally liquid.

At block 604, the method includes deriving an equation for the group based on manufacturer data of the centrifugal pumps collectively in the group. The equation correlates NPSHr with flowrate of pumped fluid. In some implementations, the derived equation is an exponential equation. The manufacturer data (e.g., pump FAT data) includes NPSHr for each centrifugal pump of the group as a function of the flowrate of the pumped fluid. The manufacturer data may include FAT NPSHr curves.

The manufacturer data for NPSHr at a given flowrate of the pumped fluid varies among the centrifugal pumps of the group, respectively, and wherein deriving the equation may involve fitting select values of the NPSHr of the manufacturer data among the centrifugal pumps of the group. The select values may include maximum values, median values, or average values, or massaged variations of these values, of the NPSHr of the manufacturer data of the centrifugal pumps collectively of the group at given flowrates. The deriving of the equation may include fitting NPSHr values of the manufacturer data to a curve, wherein the NPSHr values include maximum values, median values, or average values of the NPSHr of the manufacturer data of the centrifugal pumps, respectively, at same flowrates. The technique may utilized massaged variations of these maximum values, median values, or average values, or other values.

At block 606, the method includes specifying a NPSH margin for NPSHa above the NPSHr. The NPSH margin may be the difference of NPSHa determined by a control system minus NPSHr determined by the control system via the derived equation. The NPSH margin for NPSHa above NPSHr may be specified as a contingency or added protection. As discussed, the NPSH margin specified may be, for example, at least 0.5 m, at least 0.8 m, at least 1 m, at least 1.2 m, at least 1.5 m, at least 1.8 m, or at least 2 m. The NPSH margin specified may be in the range, for example, of 0.5 to 2. The control system may take action (e.g., see block 614) in response to the actual NPSH margin dropping below the specified NPSH margin.

At block 608, the method may include calculating, via the equation, the NPSHr for each centrifugal pump in operation of the group. At block 610, the method may include determining the NPSHa for each centrifugal pump in operation of the group. At block 612, the method may include comparing the NPSHa for each centrifugal pump in operation of the group to the NPSHr as calculated via the equation for each centrifugal pump in operation of the group, respectively.

At block 614, the method includes shutting down a centrifugal pump in operation of the group in response to the NPSHa for that centrifugal pump being less than a sum of the NPSHr calculated via the equation for that centrifugal pump plus the NPSH margin as specified. The NPSHr calculated for the centrifugal pump that is shutdown may be calculated, via the equation, at an operating flowrate of the pumped fluid through that centrifugal pump prior to shutting down that centrifugal pump.

In implementations, the centrifugal pumps of the group include a first centrifugal pump, a second centrifugal pump, a third centrifugal pump, and a fourth centrifugal pump, wherein the first centrifugal pump is the centrifugal pump shutdown in response to the NPSHa for the first centrifugal pump being less than a sum of the NPSHr calculated via the equation for the first centrifugal pump plus the NPSH margin as specified. The shutting down of the first centrifugal pump may generally involve taking the first centrifugal pump out of operation, and can include stopping supply of electricity to a motor of the first centrifugal pump. The automatic shutting down can be characterized as turning off the first centrifugal pump, such as turning off electricity to the first centrifugal pump or turning off a motor of the first centrifugal pump, and the like.

At block 616, the method may include placing into operation a centrifugal pump of the group not in operation in response to shutting down (block 614) a centrifugal pump. The centrifugal pump placed in operation may be sister pump (spare ready for operation) of the centrifugal pump automatically shut down. The method may include placing the second centrifugal pump into operation in response to shutting down the first centrifugal pump. Such may involve adjusting operating positions of valves on the suction side and discharge side of the first and second centrifugal pumps (e.g., as sister pumps). The position of a switch may be altered to apply electricity to the motor of the second centrifugal pump to initiate operation of the second centrifugal pump.

Lastly, in certain embodiments, the pumped fluid of each centrifugal pump of the group may include boiler feedwater. The method may include providing boiler feedwater as pumped fluid from the group to a boiler or to an HRSG.

An embodiment is a method of operating centrifugal pumps related to NPSH, the method including grouping multiple centrifugal pumps in a system for application of an equation to the multiple centrifugal pumps, the equation giving NPSHr as a function of flowrate of pumped fluid. The method includes developing the equation based collectively on manufacturer data of each centrifugal pump of the multiple centrifugal pumps, wherein the manufacturer data varies respectively among the multiple centrifugal pumps. The manufacturer data may correlate NPSHr with the flowrate of the pumped fluid. The manufacturer data may be FAT data for each centrifugal pump of the multiple centrifugal pumps, the FAT data giving NPSHr for each centrifugal pump of the multiple centrifugal pumps as a function of the flowrate of the pumped fluid. The developing of the equation may be based collectively on manufacturer data of each centrifugal pump of the multiple centrifugal pumps involving selecting NPSHr values that are average, median, or maximum of the FAT data of the multiple centrifugal pumps at respective differing flowrates and deriving the equation with the NPSHr values as selected. The method includes specifying as a protection a NPSH margin (e.g., at least 0.8 m) for NPSHa above the NPSHr. The method includes shutting down a centrifugal pump of the multiple centrifugal pumps in response to the NPSHa for that centrifugal pump being less than a sum of the NPSHr calculated via the equation for that centrifugal pump plus the NPSH margin as specified. The method may include calculating, via the equation, the NPSHr for each centrifugal pump in operation of the multiple centrifugal pumps, determining the NPSHa for each centrifugal pump in operation of the multiple centrifugal pumps, and comparing the NPSHa for each respective centrifugal pump in operation of the multiple centrifugal pumps to the NPSHr as calculated via the equation for each respective centrifugal pump in operation of the multiple centrifugal pumps. The method may include pumping boiler feedwater as the pumped fluid from the group to a boiler.

Another embodiment is a method of operating centrifugal pumps related to NPSH, the method including designating a group of centrifugal pumps (e.g., at least four centrifugal pumps) in a system. The method includes generating a single equation for the group based on manufacturer data of the centrifugal pumps collectively in the group. The single equation (e.g., an exponential equation) correlates NPSHr with flowrate of pumped fluid. The manufacturer data gives the NPSHr for each centrifugal pump of the group as a function of the flowrate of the pumped fluid. The NPSHr of the manufacturer data at a given flowrate of the pumped fluid (e.g., water) varies among the centrifugal pumps of the group. The manufacturer data may be FAT data of each centrifugal pump in the group, the FAT data giving the NPSHr for each centrifugal pump of the group as a function of the flowrate of the pumped fluid based on factory acceptance tests performed on each centrifugal pump of the group. The generating of the single equation for the group based on the manufacturer data may include selecting NPSHr values that are average, median, or maximum of the FAT data among the centrifugal pumps in the group at respective differing flowrates of the pumped fluid and fitting the NPSHr values as selected to an equation to give the single equation. The method includes specifying a NPSH margin (e.g., at least 0.5 m or at least 0.8 m) for NPSHa above the NPSHr. The method includes calculating, via the single equation, NPSHr for each centrifugal pump in operation of the group at a respective operating flowrate of the pumped fluid. The method may include determining the NPSHa for each centrifugal pump in operation of the group. The method includes comparing the NPSHa for each respective centrifugal pump in operation of the group to a sum of the NPSH margin plus the NPSHr as calculated via the single equation for each respective centrifugal pump in operation of the group. The method may include shutting down a centrifugal pump in operation of the group in response to the NPSHa for that centrifugal pump being less than a sum of the NPSHr calculated via the single equation for that centrifugal pump plus the NPSH margin as specified. In implementations, each centrifugal pump of the group is a BFW pump, and the method include pumping boiler feedwater as the pumped fluid from a centrifugal pump of the group to a boiler.

EXAMPLE

This Example is only an example and not intended to limit the present techniques. In this Example, twenty boiler feedwater (BFW) pumps (centrifugal pumps) for five power generation blocks of a power plant in a petrochemical refinery complex were designated as a group. Each power block had a combined cycle (Brayton-Rankine). In particular, each of the five power blocks had two gas turbines (Brayton cycle) with two HRSGs and one steam turbine (Rankine cycle). In each power block, the two gas turbines fed hot combustion gas to the two HRSGs, respectively, and the two HRSGs fed superheated steam to the one steam turbine to drive the steam turbine. Each HRSG (ten in total) of the five power blocks was serviced by two respective BFW pumps of the twenty BFW pumps in the designated group. Each such pair of BFW pumps were sister pumps with one running while the other was on hot standby. The twenty BFW pumps in the group may be critical in that a pair of the BFW pumps for a given power block being out of service could have rendered the entire combined cycle (Brayton-Rankine) for that power block out of service. The twenty BFW pumps were designated as a group so to be controlled, in part, via an equation that calculated NPSHr based on flowrate of pumped fluid for the group.

The equation was derived collectively for the group based on the respective FAT NPSHr curve for each pump of the twenty pumps. The NPSHr curve plotted NPSHr values versus the volumetric flowrate. The FAT NPSHr curve for each pump of the twenty pumps gave NPSHr (y-axis) versus volumetric flowrate (x-axis). For a given pump, the FAT NPSHr curve was available from the FAT performance curves for that pump. The form of the equation to be derived was chosen to be exponential in view of the general behavior of the NPSHr curve on the FAT NPSHr curves. In particular, the form of the equation was specified as $NPSHr=A+B\cdot\exp(Cx+D)$, where x is the x-axis variable (flowrate here), A and D affect the expression deflection in x and y, and B and C shrink and stretch the expression. NPSHr values from the respective FAT NPSHr curve at various flowrates for each of the twenty pumps was tabulated, as shown in Table 2. The maximum NPSHr value among the twenty pumps at each volumetric flowrate was utilized to derive the equation. To do so, the maximum values were fitted to an equation with the aforementioned equation form via Desmos™ software available from Desmos, Inc. having headquarters in San Francisco, California, USA.

TABLE 2

NPSHr data for twenty BFW pumps from respective FAT NPSHr curves

| Volumetric Flowrate ($m^3$/h) | 250 | 490 | 550 | 730 | 800 | 887 | 935 | 970 |
|---|---|---|---|---|---|---|---|---|
| NPSHr (m) for Pump 1101A | 7 | 9 | 9.2 | 11.5 | 13 | 16.5 | 20 | 23.5 |
| NPSHr (m) for Pump 1101B | 8 | 9 | 9.9 | 12 | 13.5 | 17.8 | 21 | 25 |
| NPSHr (m) for Pump 1201A | 8 | 9 | 9.5 | 11 | 13 | 16 | 20 | 24 |
| NPSHr (m) for Pump 1201B | 7 | 7.5 | 8 | 11.5 | 13 | 16 | 18 | 20 |
| NPSHr (m) for Pump 2101A | 7 | 8.5 | 9.6 | 12 | 13 | 17 | 20 | 23.5 |
| NPSHr (m) for Pump 2101B | 7.5 | 8.5 | 9 | 11.5 | 13 | 17 | 19 | 23 |
| NPSHr (m) for Pump 2201A | 7 | 9 | 9.2 | 10.5 | 11.5 | 14 | 16 | 18 |
| NPSHr (m) for Pump 2201B | 7 | 8.5 | 9 | 11 | 13 | 15.5 | 17.5 | 20 |
| NPSHr (m) for Pump 3101A | 7.5 | 9 | 10 | 12 | 13 | 16 | 18 | 20 |
| NPSHr (m) for Pump 3101B | 7 | 9 | 9 | 11 | 13 | 16 | 17.5 | 21 |
| NPSHr (m) for Pump 3201A | 4 | 8 | 9 | 10.5 | 13 | 16 | 18.5 | 22 |
| NPSHr (m) for Pump 3201B | 7 | 9 | 9.5 | 12 | 13.5 | 17 | 19.5 | 22 |
| NPSHr (m) for Pump 4101A | 7.5 | 8 | 9 | 10.5 | 12 | 15 | 17 | 20 |
| NPSHr (m) for Pump 4101B | 7.5 | 8 | 9.2 | 11 | 12 | 14.5 | 16 | 18 |
| NPSHr (m) for Pump 4201A | 8 | 8 | 9 | 11 | 12.5 | 15.5 | 17 | 19 |
| NPSHr (m) for Pump 4201B | 7.5 | 9 | 9 | 11 | 13 | 16 | 18 | 21 |
| NPSHr (m) for Pump 5101A | 7 | 8 | 9 | 11 | 12 | 15 | 18 | 20.5 |
| NPSHr (m) for Pump 5101B | 7 | 7.5 | 8 | 11 | 12 | 15 | 17 | 19 |
| NPSHr (m) for Pump 5201A | 7 | 8 | 8.5 | 11 | 12 | 15 | 16.5 | 18.5 |
| NPSHr (m) for Pump 5201B | 7 | 8 | 9 | 11 | 13 | 17.5 | 20 | 23.5 |
| Highest FAT NPSHr (m) | 8 | 9 | 10 | 12 | 13.5 | 17.8 | 21 | 25 |

In Table 2 with respect to the pump name nomenclature, the "A" and "B" for pumps names having the same numbers is in reference to pairing as sister pumps that supply the same user. For instance, pump 1101A and pump 1101B are sister pumps that supply BFW to the same HRSG and in which typically one pump is in operation, while the other pump is an adjacent spare pump in place and ready for operation.

The last row of Table 2 gives the highest (maximum) NPSHr of the twenty BFW pumps for the flowrate of the column. For instance, the highest NPSHr of the twenty BFW pumps at a flowrate of 250 $m^3$/h is 8 meters. The respective NPSHr curve for three pumps (pump 1101B, pump 1201A, and pump 4201A) contributed this maximum NPSHr of 8 meters at 250 $m^3$/h.

After fitting the NPSHr maximum values of the NPSHr FAT data at the various volumetric flowrates, the derived equation was $NPSHr=8.6+1.1\cdot\exp(0.0059\cdot Q-3)$, where Q is the volumetric flowrate. Again, this equation was derived based collectively on FAT NPSHr data of the individual BFW centrifugal pumps in the group to be applied as a group equation (a single equation) to each of the BFW centrifugal pumps in the group.

Figure 7:
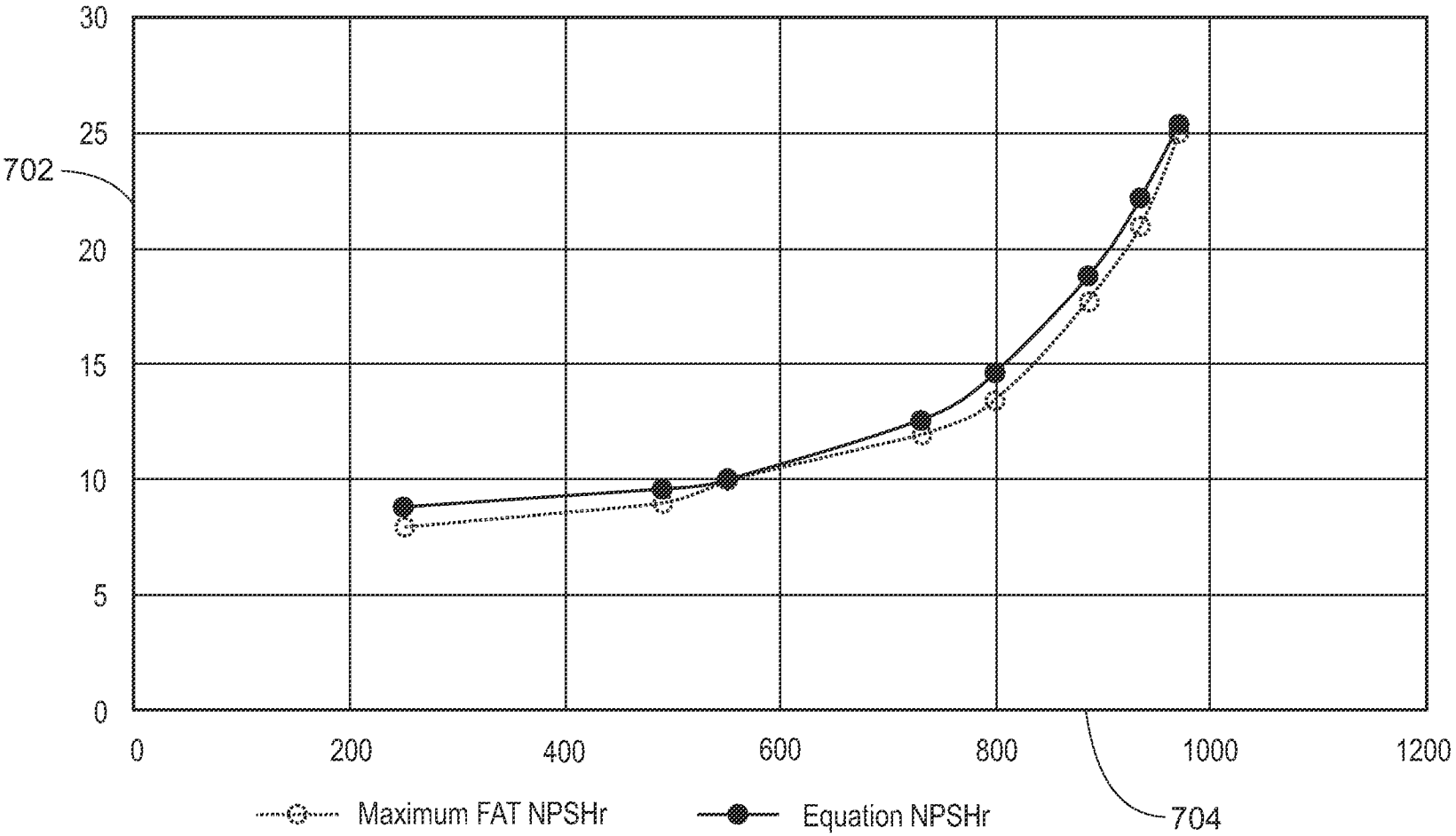
FIG. 7 is a plot of net positive suction head required (NPSHr) for a pump versus volumetric flowrate of pumped fluid through the pump.

FIG. 7 is a plot 700 of NPSHr 702 (meters) versus volumetric flowrate 704 (m3/h). The dotted circles plotted are the maximum (highest) NPSHr values from the last row of Table 2. A dotted line (curve) is drawn through the dashed circles. The solid black circles are the NPSHr as calculated vis the derived equation $NPSHr=8.6+1.1\cdot\exp(0.0059\cdot Q-3)$ at volumetric flow rates (Q) of the columns in Table 2. A line (curve) is drawn through the solid black circles. As can be seen, the derived equation outputs NPSHr values that are similar to the FAT NPSHr maximum values of the twenty BFW centrifugal pumps.

Figure 8:
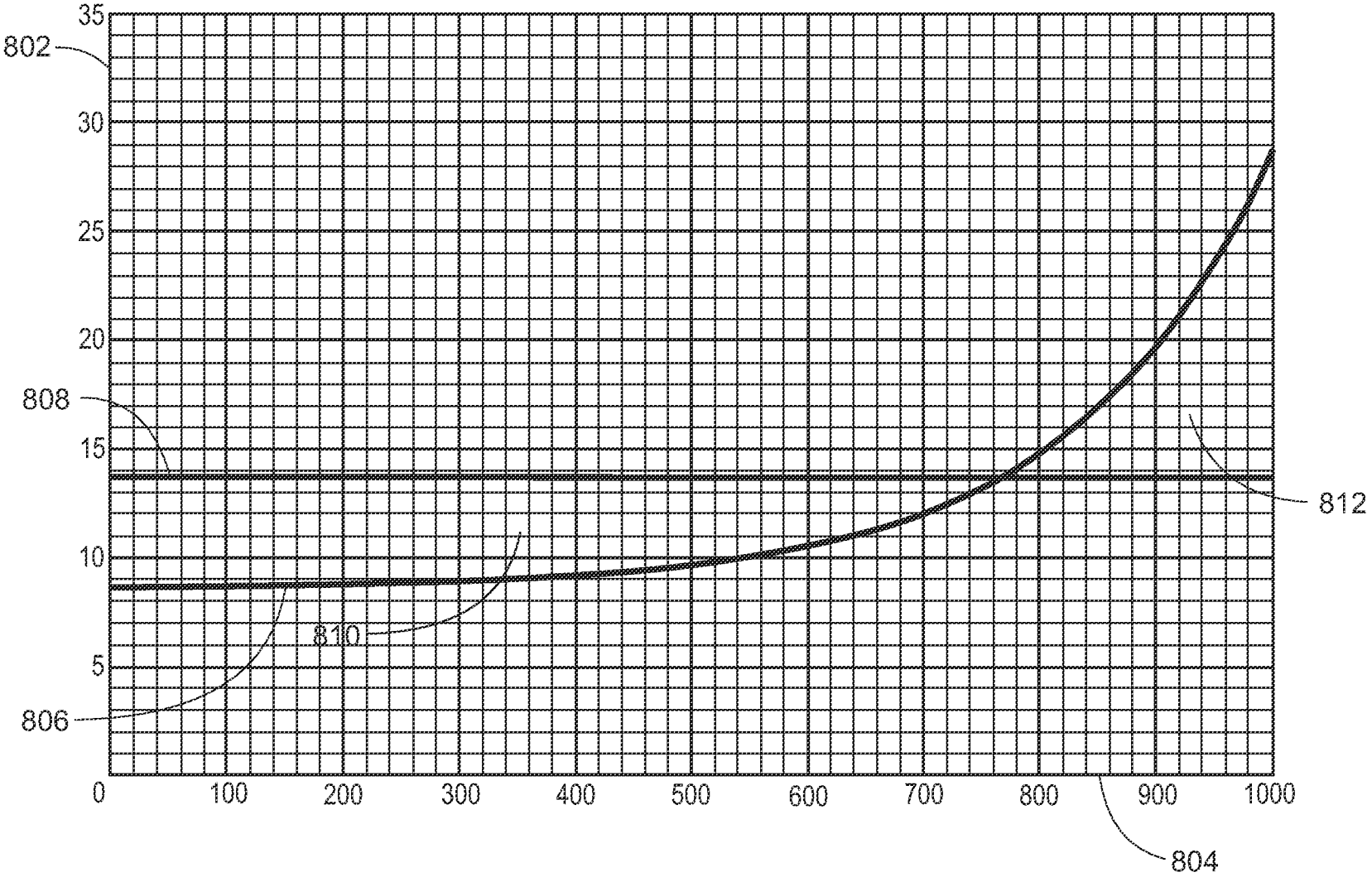
FIG. 8 is a plot of pump NPSHr versus pump volumetric flowrate.

FIG. 8 is a plot 800 of NPSHr 802 (meters) versus volumetric flowrate 804 (Q in m3/h). The curve 806 is the derived equation $NPSHr=8.6+1.1\cdot\exp(0.0059\cdot Q-3)$. The curve 806 is the NPSHr as calculated by the derived equation over the range of the volumetric flowrate 804. The line 808 is a horizontal line at an NPSHr of constant 13.7 meters across the range of the volumetric flowrate 804. A previous technique at this power plant of the facility in this Example was to specify a constant NPSHr of 13.7 meters for comparison to NPSHa for the twenty pump in deciding whether to shut down the pump to avoid potential cavitation. Thus, that evaluation did not consider the impact of flowrate of the pumped fluid on NPSHr but instead fixed NPSHr in the evaluation at 13.7 meters independent of the flowrate. The region 810 below the line 808 (and above the equation curve 806) may be an operating domain in which the previous technique had a tendency in certain instances to unnecessarily automatically shut down a pump due to concern (as automated) of cavitation when the pump was not approaching cavitation. The region 812 above the line 808 (and below the equation curve 806) may be an operating domain in which the previous technique had a tendency in certain instances to not automatically shut down a pump when the pump was approaching and experiencing cavitation. The crossover point between the two regions is at 768.46 $m^3$/h.

The derived equation $NPSHr=8.6+1.1\cdot\exp(0.0059\cdot Q-3)$ was applied as a group equation (a single equation) to each of the twenty BFW centrifugal pumps in operation in the group. Logic (code) was incorporated into the plant control system to program the control system for aspects of this Example. The control system was programmed to store the derived equation and to calculate NPSHr for each pump in the group with the derived equation at the operating flowrate of the pumped fluid through the pump. The control system was programmed to trip (automatically shut down) a pump when NPSHa for that pump was less than NPSHr (as calculated via the derived equation) plus a specified NPSH margin (here was specified as 1 meter). The control system was already programmed to calculate NPSHa including as a function of pump suction pressure and temperature.

Most of the respective discharge of BFW of each of the twenty BFW pumps when in operation was forwarded as a high-pressure (HP) stream. The remainder of the respective discharge of BFW of each of the twenty BFW pumps when in operation was forwarded as an intermediate-pressure (IP) stream lower in pressure than the HP stream. The mass flowrate of the respective HP stream was measured with a mass meter. The flowrate of the respective IP stream, which was approximately equal to 10% of the flowrate of the respective HP stream, was not measured. Therefore, the total mass flowrate through a given BFW pump in operation in the group was approximated as the mass flowrate of the respective HP stream (as measured) multiplied by 1.1. This mass flowrate in kilograms per hour (kg/h) as approximated for each pump BWF was converted to volumetric flowrate ($m^3$/h) for applying the derived equation to the pump, such that the control system calculated the NPSHr based on the volumetric flow rate. The mass flowrate (kg/h) was divided by the BFW density (902 kg/m$^3$) corresponding to the temperature of 165° C. during the FAT to give the volumetric flowrate (m$^3$/h) for the NPSHr calculation via the derived equation.

Table 3 and Table 4 each give a comparison of the new technique of calculating NPSHr via the derived equation versus the old technique of specifying NPSHr at a fixed 13.7 meters. The first two rows (HP mass flowrate and calculated actual NPSHa) in each of Tables 3 and 4 are for pump 1101A of the twenty BFW centrifugal pumps in the group. All values in Tables 3 and 4 are given in meters, except for HP mass flowrate given in kg/hr. If the actual NPSHa drops to the NPSHa trip value, the control system will automatically shut down the pump. The old NPSHa trip value is a constant 14.7 meters is the arbitrarily specified NPSHr at constant 13.7 meters (independent of flow rate) plus the specified NPSH margin of 1 meter. The new NPSHa trip value is NPSHr calculated via the Example derived equation (based on FAT data and a function of flow rate) plus the specified NPSH margin of 1 meter. The NPSHr was so calculated by the control system with the total volumetric flow rate that was converted from total mass flow rate equal to the tabulated HP mass flow rate multiplied by 1.1. The old Δ is the difference between the actual NPSHa minus the old NPSHa trip value. The new Δ is the difference between the actual NPSHa minus the new NPSHa trip value.

TABLE 3

Comparison of New Technique versus Old Technique for Pump 1101A

| HP (kg/hr) | 518,000 | 500,000 | 500,000 | 499,000 | 478,000 | 499,000 | 501,000 |
|---|---|---|---|---|---|---|---|
| NPSHa | 33.2 | 31.2 | 33.31 | 26.53 | 25.79 | 29 | 26 |
| Old NPSHa trip | 14.7 | 14.7 | 14.7 | 14.7 | 14.7 | 14.7 | 14.7 |
| New NPSHa trip | 11.9 | 11.6 | 11.6 | 11.6 | 11.3 | 11.6 | 11.6 |
| Old Δ | 18.5 | 16.5 | 18.61 | 11.83 | 11.09 | 14.3 | 14.3 |
| New Δ | 20.3 | 18.6 | 20.7 | 13.9 | 13.5 | 16.4 | 16.4 |

TABLE 4

Comparison of New Technique versus Old Technique for Pump 1101A

| HP (kg/hr) | 501,000 | 503,000 | 500,000 | 500,000 | 489,000 | 38,000 | 31,000 |
|---|---|---|---|---|---|---|---|
| NPSHa | 28.4 | 24.28 | 22.46 | 22.74 | 19 | 12.95 | 8.54 |
| Old NPSHa trip | 14.7 | 14.7 | 14.7 | 14.7 | 14.7 | 14.7 | 14.7 |
| New NPSHa trip | 11.6 | 11.6 | 11.6 | 11.6 | 11.4 | 9.7 | 9.7 |
| Old Δ | 13.7 | 9.58 | 7.76 | 8.04 | 4.3 | −1.75 | −6.16 |
| New Δ | 15.8 | 11.6 | 9.9 | 10.1 | 6.6 | 2.3 | −2.1 |

As can be seen in Tables 3 and 4, the new Δ is greater than the old Δ. This means that under the old technique (with NPSHr specified at fixed 13.7 m), the control system tended to trip pumps not in cavitation condition because the new technique (with NPSHr calculated via the derived equation) is more accurate in relying on manufacturer FAT NPSH data for determining NPSHr.

A number of implementations have been described. Nevertheless, it will be understood that various modifications may be made without departing from the spirit and scope of the disclosure.

What is claimed is:

1. A method of operating centrifugal pumps related to net positive suction head (NPSH), the method comprising:

identifying a group of centrifugal pumps in a system, each centrifugal pump in the group of a same construction and having same manufacturer NPSH required (NPSHr) as determined for the same construction, wherein the manufacturer NPSHr does not vary among the centrifugal pumps in the group at a given flowrate of pumped fluid, wherein a manufacturer or vendor after completion of manufacture of each centrifugal pump, respectively, of the group, performs a factory acceptance test (FAT) of each individual centrifugal pump, respectively, giving FAT data unique to each individual centrifugal pump, respectively, the FAT comprising a functional test, wherein the FAT data comprises FAT NPSHr for each centrifugal pump of the group as a function of the flowrate of pumped fluid as determined via the functional test performed for each individual centrifugal pump, respectively, in the group that gave the FAT data unique for each individual centrifugal pump, respectively, wherein the FAT NPSHr is capable of deviating from the manufacturer NPSHr, wherein the FAT NPSHr is capable of varying among the centrifugal pumps in the group at a given flowrate, wherein a number of the centrifugal pumps in the group is in a range of 4 to 60;

deriving a single equation for the group utilized to calculate NPSHr of each centrifugal pump in the group, wherein output of the single equation is only NPSHr, the single equation giving the same NPSHr for each centrifugal pump at a given flowrate of pumped fluid, the single equation correlating NPSHr with the flowrate of pumped fluid and derived based on from select values of the FAT data of the group, and wherein the select values are only a maximum numerical value of FAT NPSHr among the centrifugal pumps at each given flowrate of pumped fluid;

specifying a NPSH margin for NPSH available (NPSHa) above the NPSHr as calculated via the single equation; and shutting down a centrifugal pump in operation of the group in response to the NPSHa for that centrifugal pump being less than a sum of the NPSHr as calculated via the single equation for that centrifugal pump plus the NPSH margin as specified.

2. The method of claim 1, comprising:

calculating, via the single equation, the NPSHr for each centrifugal pump in operation of the group, wherein input to the single equation is only the flowrate of pumped fluid;

determining the NPSHa for each centrifugal pump in operation of the group; and comparing the NPSHa for each centrifugal pump in operation of the group to the NPSHr as calculated via the single equation for each centrifugal pump in operation of the group, respectively, wherein the single equation comprises an exponential equation.

3. The method of claim 1, comprising placing into operation a centrifugal pump not in operation of the group in response to shutting down the centrifugal pump with the NPSHa less than the sum, wherein the NPSH margin comprises at least 0.5 meter (m), and wherein the FAT data comprises FAT NPSHr curves.

4. The method of claim 1, wherein the FAT NPSHr at a given flowrate of pumped fluid varies among the centrifugal pumps of the group, respectively, and wherein deriving the single equation comprises fitting the select values consisting of the maximum numerical value of the FAT NPSHr among the centrifugal pumps of the group at each given flowrate.

5. The method of claim 4, comprising applying a first factor to the select values for deriving the single equation, or applying a second factor to the NPSHr as calculated via the single equation, or both.

6. The method of claim 1, comprising providing boiler feedwater from the group to a boiler, wherein the pumped fluid comprises the boiler feedwater, and wherein deriving the single equation consists of fitting the select values consisting of the maximum numerical value of the FAT NPSHr among the centrifugal pumps of the group at each given flowrate.

7. The method of claim 1, wherein deriving the single equation comprises fitting the select values to a curve, wherein the select values consist of only the maximum numerical value of the FAT NPSHr among the centrifugal pumps in the group at each given flowrate.

8. The method of claim 1, wherein identifying the group comprises specifying or designating the group, wherein the NPSHr calculated for the centrifugal pump that is shutdown is calculated, via the single equation, at an operating flowrate of the pumped fluid through that centrifugal pump prior to shutting down that centrifugal pump.

9. The method of claim 1, wherein the centrifugal pumps of the group comprise a first centrifugal pump, a second centrifugal pump, a third centrifugal pump, and a fourth centrifugal pump, wherein the first centrifugal pump comprises the centrifugal pump shutdown in response to the NPSHa for the first centrifugal pump being less than a sum of the NPSHr calculated via the single equation for the first centrifugal pump plus the NPSH margin as specified, and wherein the single equation comprises an exponential equation.

10. The method of claim 9, comprising placing the second centrifugal pump into operation in response to shutting down the first centrifugal pump, wherein the FAT data relates the FAT NPSHr to the flowrate of the pumped fluid, and wherein the pumped fluid of each centrifugal pump of the group comprises boiler feedwater.

11. A method of operating centrifugal pumps related to net positive suction head (NPSH), the method comprising:

grouping multiple centrifugal pumps in a system for application of a single equation to the multiple centrifugal pumps, the single equation giving NPSH required (NPSHr) as a function of flowrate of pumped fluid, wherein the single equation is utilized for all of the multiple centrifugal pumps, outputs only NPSHr, and gives the same NPSHr for each centrifugal pump of the multiple centrifugal pumps at a given flowrate of pumped fluid, each centrifugal pump of a same construction and having same manufacturer NPSHr as determined by the same construction, wherein the manufacturer NPSHr does not vary among the centrifugal pumps of the multiple centrifugal pumps at a given flowrate of pumped fluid, wherein a manufacturer or vendor after completion of manufacture each centrifugal pump of the multiple centrifugal pumps, respectively, performs a factory acceptance test (FAT) of each individual centrifugal pump, respectively, giving FAT data unique to each individual centrifugal pump, the FAT comprising a functional test, wherein the FAT data comprises FAT NPSHr for each centrifugal pump as a function of the flowrate of pumped fluid as determined via the functional test performed for each individual centrifugal pump, respectively, wherein the FAT NPSHr is capable of deviating from the manufacturer NPSHr;

developing the single equation based collectively on the FAT data of each centrifugal pump of the multiple centrifugal pumps, wherein the FAT data is determined via the respective functional test performed for each individual centrifugal pump of the multiple centrifugal pumps, wherein the FAT data is capable of varying respectively among the multiple centrifugal pumps at a given flowrate of pumped fluid, wherein the single equation is developed based on select values of the FAT NPSHr, and wherein the select values are only maximum numerical value of FAT NPSHr among the centrifugal pumps at each given flowrate of pumped fluid;

specifying as a protection a NPSH margin for NPSH available (NPSHa) above the NPSHr;

calculating, via the single equation, the NPSHr for each centrifugal pump in operation of the multiple centrifugal pumps;

determining the NPSHa for each centrifugal pump in operation of the multiple centrifugal pumps;

comparing the NPSHa for each respective centrifugal pump in operation of the multiple centrifugal pumps to the NPSHr as calculated via the single equation for each respective centrifugal pump in operation of the multiple centrifugal pumps; and shutting down a centrifugal pump of the multiple centrifugal pumps in response to the NPSHa for that centrifugal pump being less than a sum of the NPSHr calculated via the single equation for that centrifugal pump plus the NPSH margin as specified.

12. The method of claim 11, wherein the FAT data correlates FAT NPSHr with the flowrate of pumped fluid, wherein the single equation comprises an exponential equation, wherein input to the single equation consists of the flowrate of pumped fluid, and wherein the NPSH margin comprises at least 0.8 meter (m).

13. The method of claim 11, comprising applying a first factor to the select values for developing the single equation, or applying a second factor to the NPSHr as calculated via the single equation, or both, wherein the FAT data for each centrifugal pump of the multiple centrifugal pumps gives FAT NPSHr for each centrifugal pump of the multiple centrifugal pumps as a function of the flowrate of the pumped fluid.

14. The method of claim 13, wherein developing the single equation based collectively on the FAT data of each centrifugal pump of the multiple centrifugal pumps comprises selecting FAT NPSHr values that are the maximum numerical value of the FAT data among the multiple centrifugal pumps at respective differing flowrates as the select values and deriving the equation with the FAT NPSHr values selected as the select values.

15. The method of claim 11, comprising pumping boiler feedwater as the pumped fluid from the grouping of the multiple centrifugal pumps to a boiler.

16. The method of claim 15, wherein a heat recovery steam generator (HRSG) comprises the boiler, and wherein the HRSG is associated with a Brayton-Rankine combined cycle.

17. A method of operating centrifugal pumps related to net positive suction head (NPSH), the method comprising:

designating a group of centrifugal pumps in a system, each centrifugal pump in the group of a same construction and having same manufacturer NPSH required (NPSHr) as determined for the same construction, wherein the manufacturer NPSHr does not vary among the centrifugal pumps of the multiple centrifugal pumps at a given flowrate of pumped fluid, wherein a manufacturer or vendor after completion of manufacture each centrifugal pump of the group, respectively, performs a factory acceptance test (FAT) of each individual centrifugal pump, respectively, giving FAT data unique to each individual centrifugal pump, the FAT comprising a functional test, wherein the FAT data comprises FAT NPSHr for each centrifugal pump as a function of the flowrate of pumped fluid determined via the functional test performed for each individual centrifugal pump, respectively, wherein the FAT NPSHr is capable of deviating from the manufacturer NPSHr;

wherein the FAT data gives FAT NPSHr for each centrifugal pump of the group as a function of the flowrate of pumped fluid based on the FAT performed on each individual centrifugal pump, respectively, of the group, and wherein the FAT NPSHr at a given flowrate of pumped fluid varies among the centrifugal pumps of the group;

generating a single equation for the group based on the FAT data of the centrifugal pumps collectively in the group, wherein generating the single equation for the group based on the FAT data comprises selecting FAT NPSHr values that are a maximum numerical value of the FAT data among the centrifugal pumps in the group at respective differing flowrates of pumped fluid and fitting the FAT NPSHr values as selected to an equation to give the single equation, the single equation correlating NPSHr with the flowrate of pumped fluid and giving the same NPSHr for each centrifugal pump in the group at a given flowrate of pumped fluid, wherein output of the single equation is only NPSHr;

specifying a NPSH margin for NPSH available (NPSHa) above the NPSHr;

calculating, via the single equation, the NPSHr for each centrifugal pump in operation of the group at a respective operating flowrate of the pumped fluid;

comparing the NPSHa for each respective centrifugal pump in operation of the group to a sum of the NPSH margin plus the NPSHr as calculated via the single equation for each respective centrifugal pump in operation of the group; and shutting down a centrifugal pump in operation of the group in response to the NPSHa for that centrifugal pump being less than a sum of the NPSHr calculated via the single equation for that centrifugal pump plus the NPSH margin as specified.

18. The method of claim 17, comprising applying a first factor to FAT NPSHr values as selected for generating the single equation, or applying a second factor to the NPSHr as calculated via the single equation, or both.

19. The method of claim 17, wherein the single equation comprises an exponential equation, wherein input to the single equation consists of the flowrate of pumped fluid, wherein the pumped fluid of each centrifugal pump of the group comprises water, and wherein the centrifugal pumps in the group comprise at least four centrifugal pumps.

20. The method of claim 17, comprising:

determining the NPSHa for each centrifugal pump in operation of the group, wherein the NPSH margin comprises at least 0.5 meter, and wherein each centrifugal pump of the group comprises a boiler feedwater (BFW) pump; and pumping boiler feedwater as the pumped fluid from a centrifugal pump of the group to a boiler.

21. A system comprising:

a group of centrifugal pumps specified collectively for control via a single equation, each centrifugal pump in the group of a same construction and having same manufacturer net positive suction head required (NPSHr) as determined for the same construction, wherein the manufacturer NPSHr does not vary among the centrifugal pumps in the group at a given flowrate of pumped fluid, the single equation correlating NPSHr of the group with flowrate of pumped fluid based on factory acceptance tests (FAT) data of the centrifugal pumps and giving the same NPSHr for each centrifugal pump at a given flowrate of pumped fluid, wherein output of the single equation is only NPSHr, wherein the FAT data is from factory acceptance tests performed on each individual centrifugal pump of the group, respectively, giving FAT data unique to each individual centrifugal pump, wherein the FAT data gives FAT NPSHr for each centrifugal pump of the group as a function of the flowrate of pumped fluid, wherein the FAT NPSHr of the FAT data at a given flowrate of pumped fluid varies is capable of varying among the centrifugal pumps of the group, wherein the centrifugal pumps in the group are boiler feedwater pumps, and wherein the pumped fluid is boiler feedwater;

a control system to calculate, via the single equation, the NPSHr for each centrifugal pump in operation of the group at a respective operating flowrate of the pumped fluid and compare net positive suction head available (NPSHa) for each respective centrifugal pump in operation of the group to a sum of a net positive suction head (NPSH) margin as specified plus the NPSHr as calculated via the single equation for each respective centrifugal pump in operation of the group, wherein the control system to automatically shut down a centrifugal pump in the group in response to the NPSHa for that centrifugal pump being equal to or less than the sum, wherein the single equation correlates select values of the FAT NPSHr of the FAT data with the flowrate of the pumped fluid, the select values comprising only maximum numerical values of the FAT NPSHr of the FAT data among the centrifugal pumps in the group at differing flowrates of the pumped fluid; and a boiler to receive the boiler feedwater pumped by a centrifugal pump of the group of centrifugal pumps.

22. The system of claim 21, wherein the equation correlates the select values consisting of only the maximum numerical values of the FAT NPSHr of the FAT data multiplied by a first factor with the flowrate of the pumped fluid, or wherein the NPSHr as calculated via the single equation is multiplied by a second factor, or a combination thereof.

23. The system of claim 22, wherein the single equation comprises an exponential equation, wherein input to the single equation is only the flowrate of pumped fluid, wherein the NPSH margin as specified comprises at least 0.5 meter, and wherein the pumped fluid comprises water.

24. The system of claim 22, wherein the control system is configured to determine the NPSHa.

25. The system of claim 22, wherein the boiler is a heat recovery steam generator (HRSG), and wherein the HRSG is associated with a Brayton-Rankine combined cycle.

26. The system of claim 22, wherein a heat recovery steam generator (HRSG) comprises the boiler, and wherein the system is a power plant.

* * * * *